US007666031B2

(12) United States Patent
Kumamoto et al.

(10) Patent No.: US 7,666,031 B2
(45) Date of Patent: Feb. 23, 2010

(54) CONNECTOR

(75) Inventors: Tadashi Kumamoto, Shinagawa (JP); Mitsuru Kobayashi, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 144 days.

(21) Appl. No.: 11/826,780

(22) Filed: Jul. 18, 2007

(65) Prior Publication Data

US 2008/0207056 A1 Aug. 28, 2008

(30) Foreign Application Priority Data

Feb. 28, 2007 (JP) ..... 2007-049506

(51) Int. Cl.
*H01R 13/648* (2006.01)

(52) U.S. Cl. ..... 439/607.01

(58) Field of Classification Search ..... 439/607.01, 439/607.02, 553, 556
See application file for complete search history.

(56) References Cited

U.S. PATENT DOCUMENTS 6,402,553 B1 * 6/2002 Schwarz et al. ..... 439/607.58
6,659,796 B1 * 12/2003 Waddell et al. ..... 439/557
6,709,286 B1 * 3/2004 Korsunsky et al. ..... 439/557
2004/0058584 A1 * 3/2004 Akama et al. ..... 439/607

FOREIGN PATENT DOCUMENTS

| | | |
|---|---|---|
| JP | 5-1182 | 1/1993 |
| JP | 11-329598 | 11/1999 |
| JP | 2004-111249 | 4/2004 |

* cited by examiner

*Primary Examiner*—Alexander Gilman

(57) ABSTRACT

A plug-side connector to be connected to a jack-side connector is provided that includes a conductive housing configured to surround an electromagnetically shielded projecting part of the jack-side connector upon the plug-side connector being connected to the jack-side connector; and a leaf spring member for a plug-side electromagnetic shield, the leaf spring member including multiple conductive leaf spring pieces arranged at a pitch enabling formation of the electromagnetic shield, the leaf spring member being provided to the housing so that the leaf spring pieces are arranged in a width direction of the housing on the interior side of the housing. The leaf spring pieces are configured to come into elastic contact with a surface of the projecting part of the jack-side connector upon the plug-side connector being connected to the jack-side connector.

6 Claims, 34 Drawing Sheets

CONNECTOR

BACKGROUND OF THE INVENTION

1. Field of the Invention

The present invention relates generally to connectors, and more particularly to a plug-side connector and a jack-side connector used where data are transmitted at high rate.

2. Description of the Related Art

With recent developments in personal computers and their networks, systems are required to transmit a large amount of video data in particular. In order to transmit a large amount of video data, it is necessary to perform data transmission at high rates greater than or equal to, for example, 1 gigabit per second (Gbps).

At high data transmission rates greater than or equal to 1 Gbps, signals become shorter in wavelength, so that particularly in a part of a transmission path where a plug-side connector is connected to a jack-side connector, electromagnetic waves are likely to leak out from the connectors. Therefore, it is necessary to take measures against EMI (Electromagnetic Interference).

Meanwhile, differential transmission, which has the merit of being less susceptible to noise than conventional transmission methods, has been adopted as a data transmission method. According to differential transmission, a "+" signal to be transmitted and a "−" signal equal in magnitude and opposite in direction to the "+" signal are simultaneously transmitted using a pair of electric wires for each data item.

FIGS. 1 and 2 are diagrams showing a conventional plug-side connector 20 and a conventional jack-side connector 50. In FIGS. 1 and 2, X1-X2 indicates the width directions of the plug-side connector 20 and the jack-side connector 50, Z1-Z2 indicates the height directions of the plug-side connector 20 and the jack-side connector 50, Y1 indicates a direction in which the plug-side connector 20 is inserted into the jack-side connector 50, and Y2 indicates a direction in which the plug-side connector 20 is extracted from the jack-side connector 50. These directions are the same for the other drawings.

Here, the plug-side connector 20 is held by a hand of an operator and connected to the jack-side connector 50, which is fixed to an apparatus so as to be exposed on a side of the apparatus. The plug-side connector 20 and the jack-side connector 50 form a connector unit 10, to which the above-described differential transmission system is applied.

The plug-side connector 20 includes a zinc die-cast housing 23 and a contact assembly 30 incorporated therein. The housing 23 includes an upper cover 21 and a lower cover 22. The plug-side connector 20 is provided at an end of a cable 40. The contact assembly 30 has contact members 32 and 33 arranged and attached to a block formed of an insulator (an insulating block) 31.

The housing 23 has a frame part 25 provided at an end thereof. Further, a latch claw 27 is provided on each of the X1 and X2 sides of the housing 23.

The jack-side connector 50 has contact members 52 and 53 arranged and attached to a block formed of an insulator (an insulating block) 51. The block 51 has a front-side (Y2-side) projecting part thereof covered with an electromagnetic shield cover member 56 having a cap-like shape. A gasket 58 is attached so as to surround the front-side part of the block 51. A metallic lock part 54 projects in the Y2 direction from the front side of the block 51 at each of the X1 and X2 ends thereof.

The electromagnetic shield cover member 56 is formed by pressing carbon steel into a cap-like shape. The electromagnetic shield cover member 56 has convex parts 57 arranged on each of the upper and lower sides thereof at such a predetermined pitch as to enable formation of an electromagnetic shield. The gasket 58 is formed by pressing a metal plate of a copper alloy, and includes multiple arranged leaf spring pieces 59.

The jack-side connector 50 is mounted on an end of a printed circuit board 70 with leg parts 54*a* of the metallic lock parts 54 being fitted into and soldered to corresponding holes of the printed circuit board 70 and ends of the contact members 52 and 53 being soldered to corresponding pads on the printed circuit board 70.

The printed circuit board 70 is, for example, incorporated in a server unit 80 so that a front-side projecting part 50*a* of the jack-side connector 50 projects outside the server unit 80 in the Y2 direction through an opening 82 of a metallic panel (IO panel) 81. The electromagnetic shield member 56 of the jack-side connector 50 is electrically connected to the panel 81 of the server unit 80 through the gasket 58 so as to be at frame ground potential. The multiple leaf spring pieces 59 are in contact with the panel 81 so as to form an electromagnetic shield in the gap between the opening 82 of the panel 81 and the jack-side connector 50.

The frame part 25 of the plug-side connector 20 is fitted around the projecting part 50*a* of the jack-side connector 50, so that the contact members 32 and 33 are connected to the contact members 52 and 53, respectively, and the latch claws 27 engage the corresponding metallic lock parts 54. As a result, the plug-side connector 20 is connected to the jack-side connector 50.

The frame part 25 surrounds the projecting part 50*a*, and the housing 23 of the plug-side connector 20 is electrically connected to the electromagnetic shield cover member 56 so as to be at frame ground potential. The interior side of the frame part 25 comes into contact with the convex parts 57 of the electromagnetic shield cover member 56. The contact points are arranged at a predetermined pitch, thereby forming an electromagnetic shield where the plug-side connector 20 is connected to the jack-side connector 50.

Reference may be made to Japanese Laid-Open Patent Application No. 2004-111249 for the above-described technique.

The cable 40 may be unnecessarily pulled during operations such as system maintenance. In this case, the plug-side connector 20 is prevented from being disconnected from the jack-side connector 50 because the latch claws 27 engage the corresponding metallic lock parts 54, but the plug-side connector 20 may be moved in the Z1-Z2 or X1-X2 directions. If the plug-side connector 20 is moved, some of the convex parts 57 are separated from the interior side of the frame part 25. This causes the convex parts 57 and the frame part 25 to be in contact with each other at a pitch several times the above-described predetermined pitch, so that the electromagnetic shield may be broken to cause leakage of electromagnetic noise from this broken part.

Further, the electromagnetic shield may also be broken to cause leakage of electromagnetic noise when an operator moves or pries the plug-side connector 20 connected to the jack-side connector 50 in order to perform operations such as checking the connection.

SUMMARY OF THE INVENTION

Embodiments of the present invention may solve or reduce one or more of the above-described problems.

According to one aspect of the present invention, there is provided a connector in which one or more of the above-described problems may be solved or reduced.

According to one aspect of the present invention, there is provided a connector with increased electromagnetic shield reliability.

According to one aspect of the present invention, there is provided a plug-side connector to be connected to a jack-side connector, including a conductive housing configured to surround an electromagnetically shielded projecting part of the jack-side connector upon the plug-side connector being connected to the jack-side connector; and a leaf spring member for a plug-side electromagnetic shield, the leaf spring member including a plurality of conductive leaf spring pieces arranged at a pitch enabling formation of the electromagnetic shield, the leaf spring member being provided to the housing so that the leaf spring pieces are arranged in a width direction of the housing on an interior side of the housing, wherein the leaf spring pieces are configured to come into elastic contact with a surface of the projecting part of the jack-side connector upon the plug-side connector being connected to the jack-side connector.

According to the above-described plug-side connector, the leaf spring pieces are in elastic contact with the surface of the projecting part of the jack-side connector with the plug-side connector being connected to the jack-side connector. Accordingly, even if the plug-side connector is moved, the projecting part and the leaf spring pieces remain in contact with each other, so that the electromagnetic shield is maintained without being broken.

According to one aspect of the present invention, there is provided a jack-side connector to be connected to a plug-side connector, including a projecting part covered with a conductive electromagnetic shield cover member having a plurality of openings, the projecting part being configured to be surrounded by a conductive housing of the plug-side connector upon the plug-side connector being connected to the jack-side connector; and a leaf spring member for a jack-side electromagnetic shield, the leaf spring member having a plurality of conductive leaf spring pieces arranged at a pitch enabling formation of the electromagnetic shield, the leaf spring member being provided so that one or more of the leaf spring pieces project through a corresponding one or more of the openings of the electromagnetic shield cover member, wherein the one or more of the leaf spring pieces projecting through the corresponding one or more of the openings of the electromagnetic shield cover member come into elastic contact with an interior surface of the housing of the plug-side connector upon the plug-side connector being connected to the jack-side connector.

According to one aspect of the present invention, there is provided a jack-side connector to be connected to a plug-side connector, including a projecting part covered with a conductive electromagnetic shield cover member, the projecting part being configured to be surrounded by a conductive housing of the plug-side connector upon the plug-side connector being connected to the jack-side connector; and a gasket having a quadrilateral frame shape, the gasket being fitted to the projecting part, wherein the gasket includes a plurality of leaf spring pieces arranged at a pitch enabling formation of an electromagnetic shield, the leaf spring pieces being capable of coming into elastic contact with an end of the housing of the plug-side connector upon the plug-side connector being connected to the jack-side connector.

According to one aspect of the present invention, there is provided a jack-side connector to be connected to a plug-side connector, including a projecting part covered with a conductive electromagnetic shield cover member, the projecting part being configured to be surrounded by a conductive housing of the plug-side connector upon the plug-side connector being connected to the jack-side connector; and a leaf spring member for a jack-side electromagnetic shield, the leaf spring member having a plurality of conductive leaf spring pieces arranged at a pitch enabling formation of the electromagnetic shield, the leaf spring member being provided to the projecting part so that the leaf spring member is electrically connected to the electromagnetic shield cover member and the leaf spring pieces are arranged side by side on an exterior side of the projecting part, wherein the leaf spring pieces are configured to come into elastic contact with an interior surface of the housing upon the plug-side connector being connected to the jack-side connector.

According to one embodiment of the present invention, there is provided a connector unit including a jack-side connector having an electromagnetically shielded projecting part; and the above-described plug-side connector, the plug-side connector being configured to connect to the jack-side connector.

According to one embodiment of the present invention, there is provided a connector unit including a plug-side connector having a conductive housing; and any of the above-described jack-side connectors, the jack-side connector being configured to connect to the plug-side connector.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

Next, a description is given below, with reference to the accompanying drawings, of embodiments of the present invention.

First Embodiment

Figure 3:
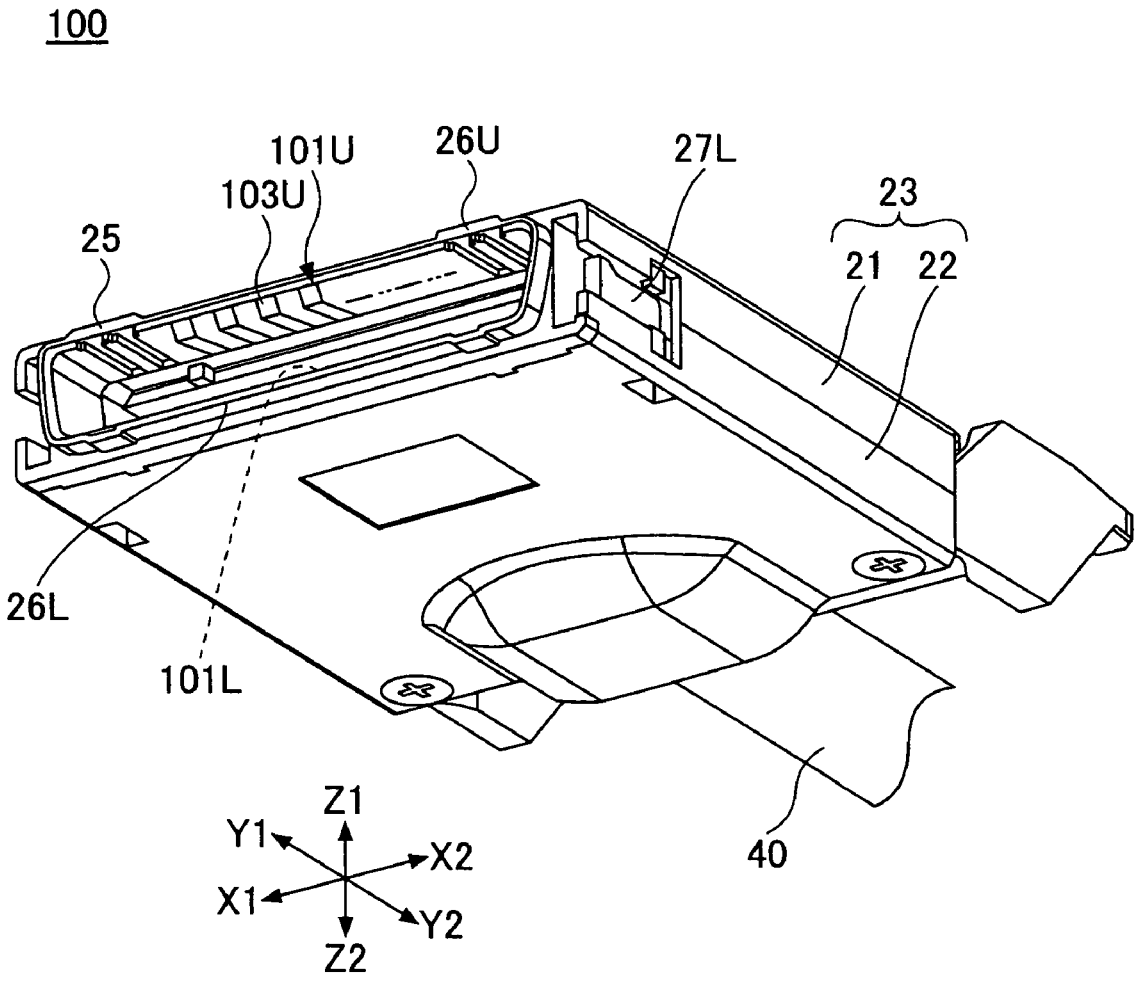
FIG. 3 is a perspective view of a plug-side connector according to a first embodiment of the present invention.

FIG. 3 is a diagram showing a plug-side connector 100 according to a first embodiment of the present invention.

Figure 1:
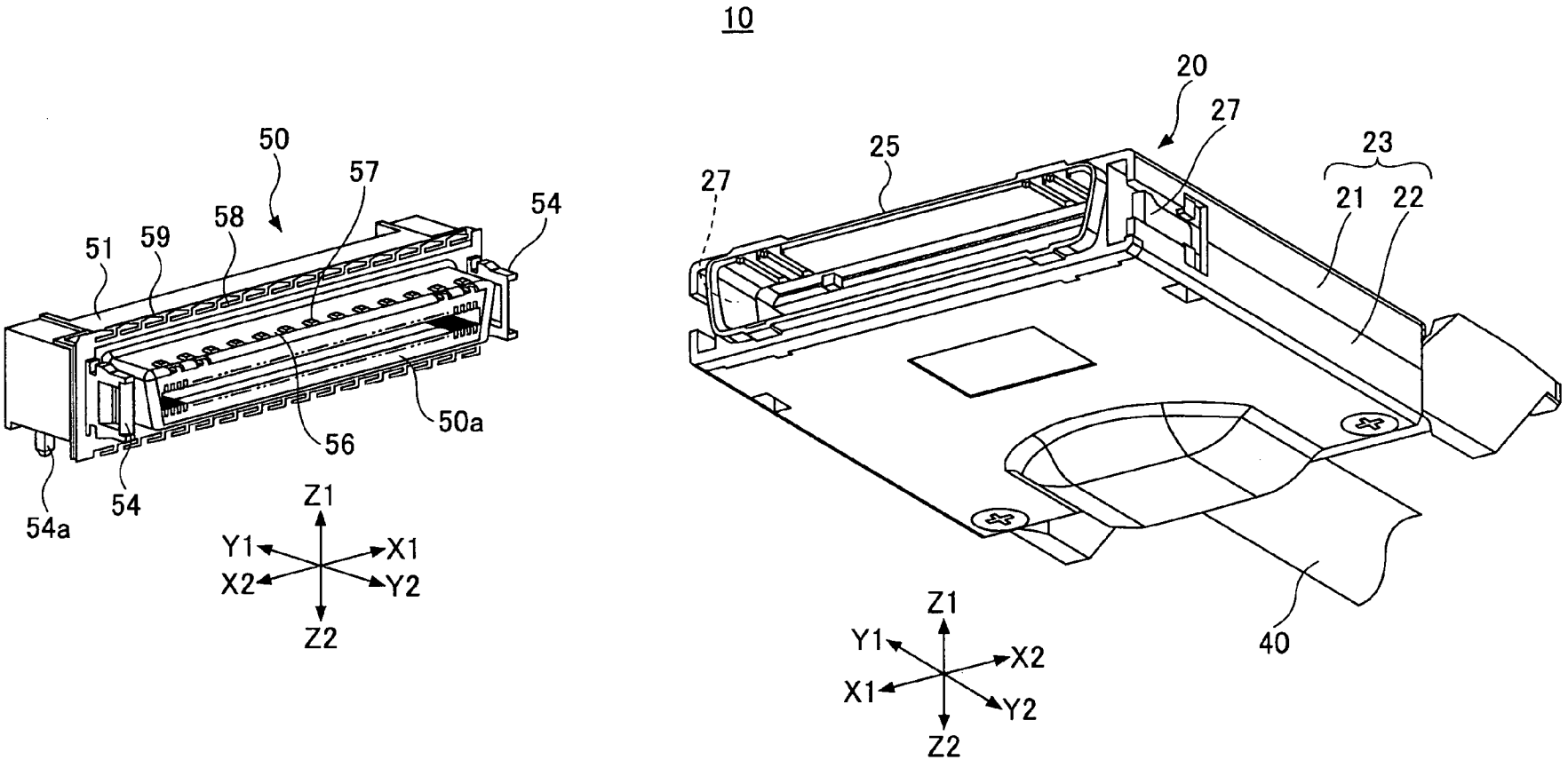
FIG. 1 is a perspective view of a conventional plug-side connector and a conventional jack-side connector.
Figure 2:
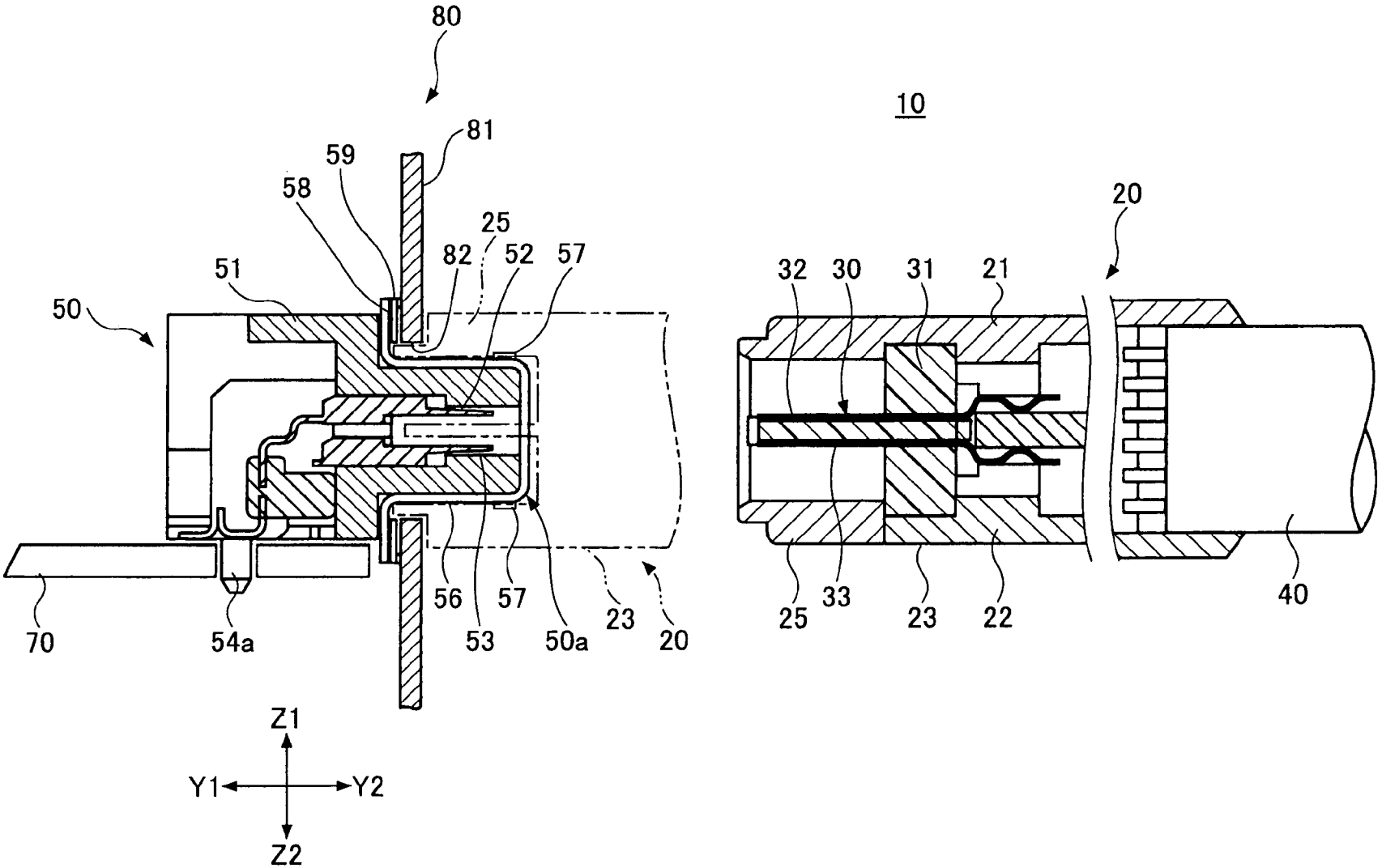
FIG. 2 is a cross-sectional view of the plug-side connector and the conventional jack-side connector.

Roughly speaking, the plug-side connector 100 is formed by attaching conductive electromagnetic shield leaf spring members 101U and 101L as leaf spring members for a plug-side electromagnetic shield to the plug-side connector 20 shown in FIG. 1. The counterpart of connection of this plug-side connector 100 is the jack-side connector 50 shown in FIG. 1. Both the plug-side connector 100 and the jack-side connector 50 adopt differential transmission.

The plug-side connector 100 has a substantially vertically symmetrical structure. Of the components (elements) of the plug-side connector 100, those provided on the upper side (Z1 side) are referred to by numerals with a suffix U and those provided on the lower side (Z2 side) are referred to by numerals with a suffix L.

Figure 4:
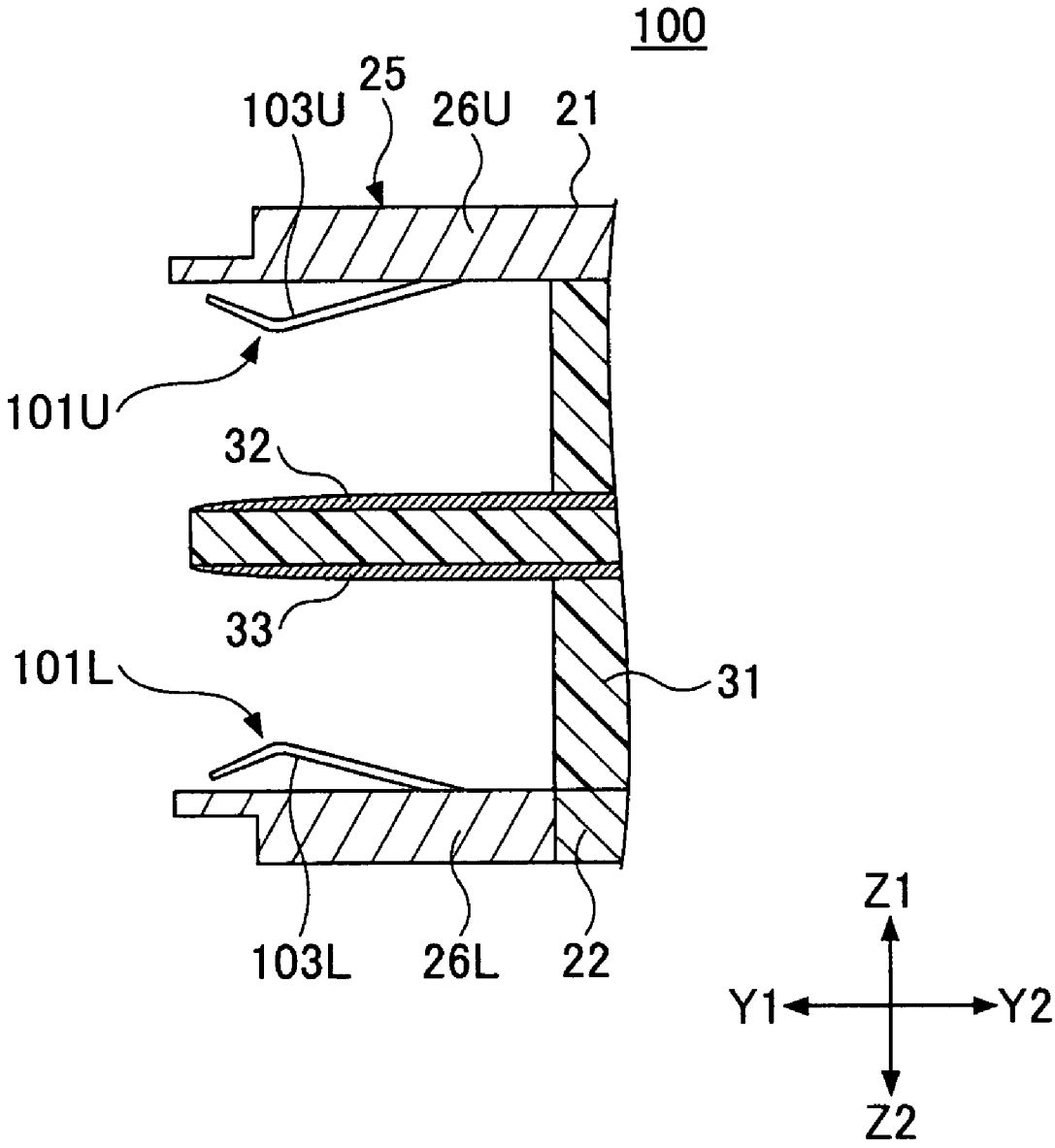
FIG. 4 is an enlarged cross-sectional view of an end part of the plug-side connector of FIG. 3 according to the first embodiment of the present invention.
Figure 5:
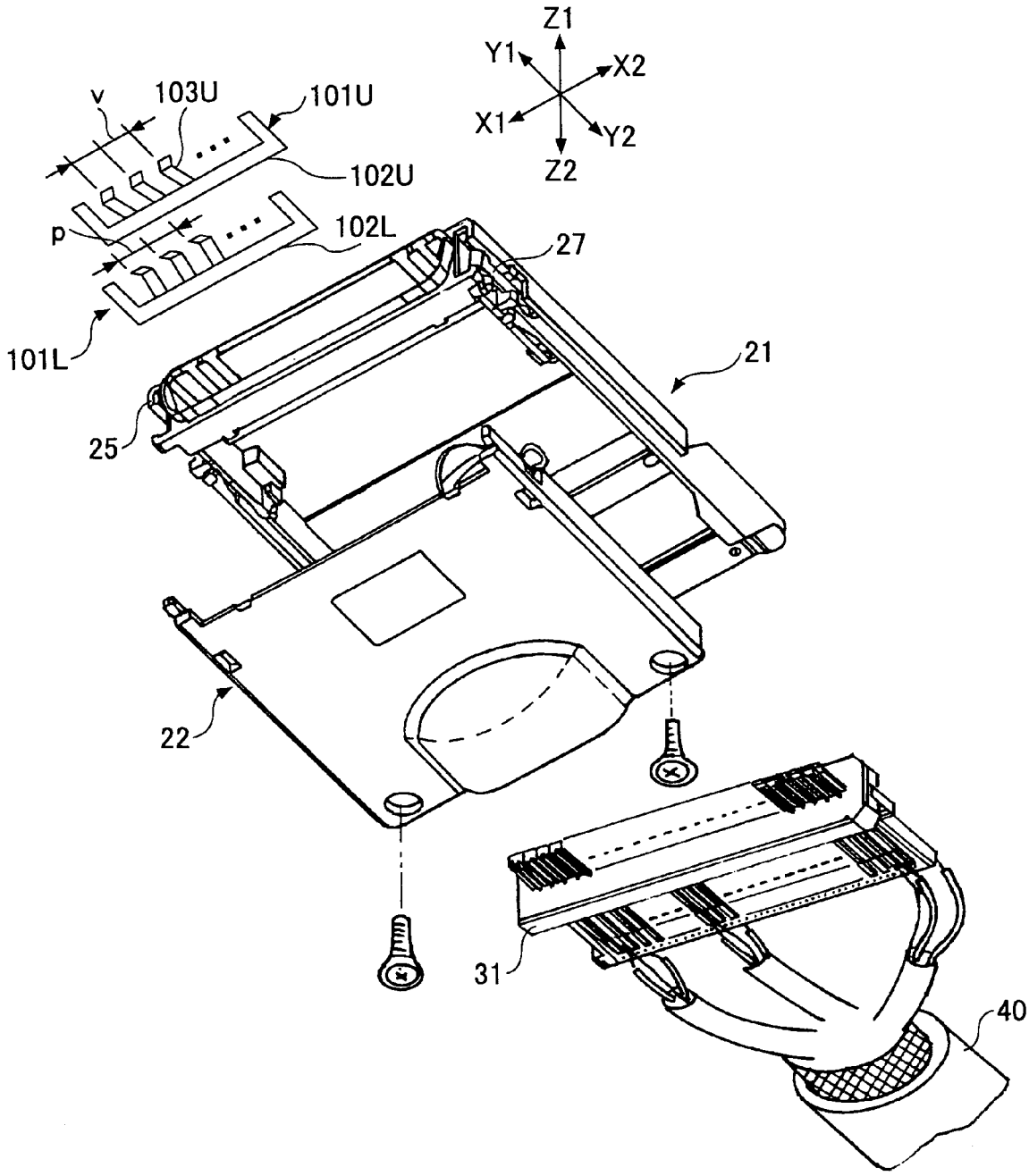
FIG. 5 is an exploded perspective view of the plug-side connector of FIG. 3 according to the first embodiment of the present invention.
Figure 6:
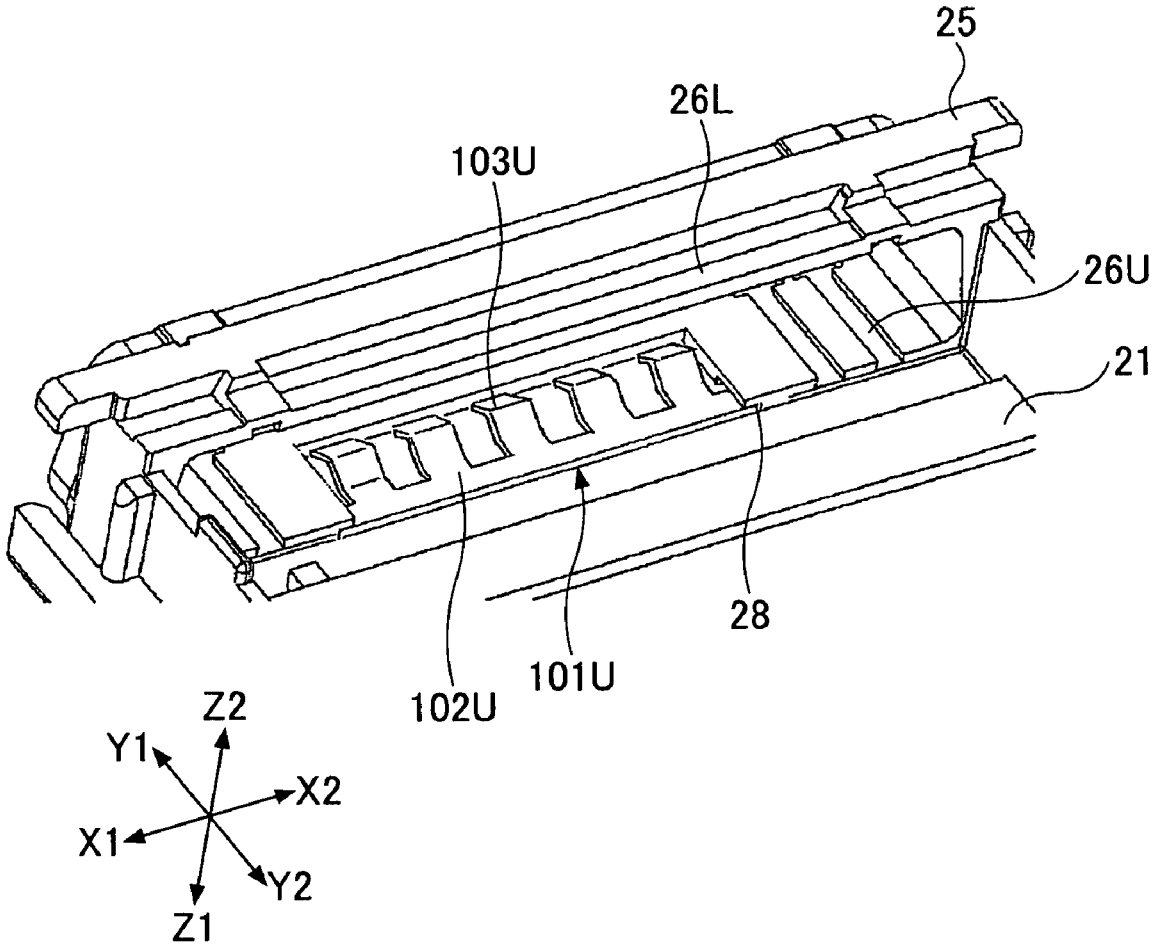
FIG. 6 is a diagram showing a leaf spring member in a fixed state with an upper cover being turned upside down according to the first embodiment of the present invention.
Figure 7A:
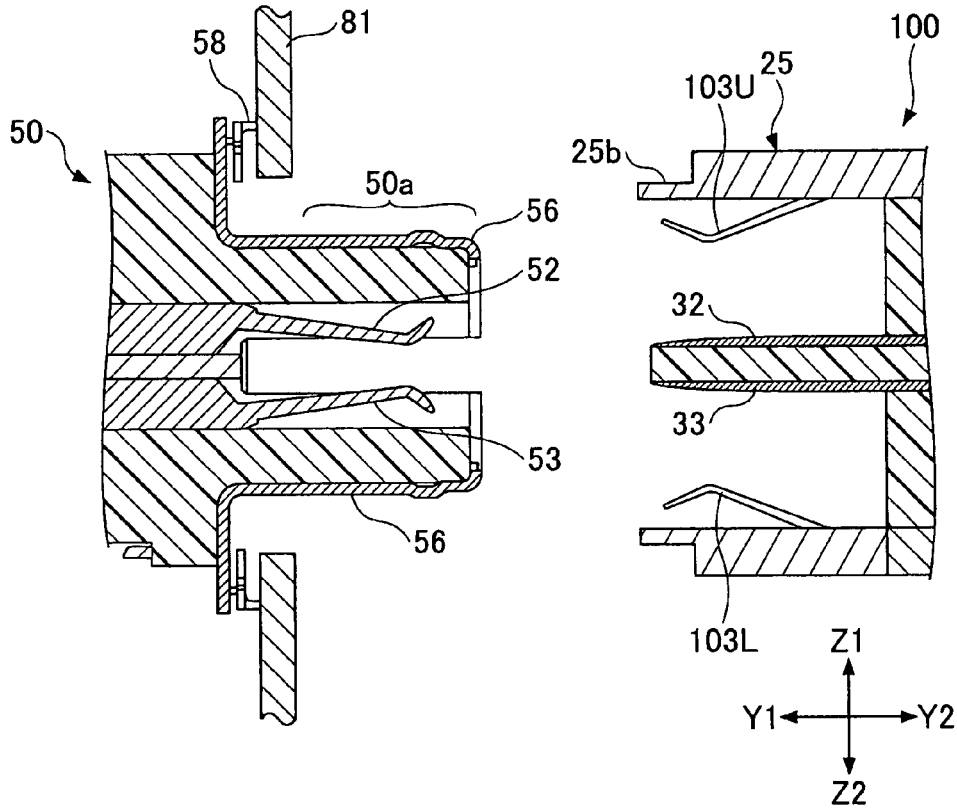
FIG. 7A is a diagram showing the plug-side connector of FIG. 3 and the jack-side connector face to face with each other.
Figure 7B:
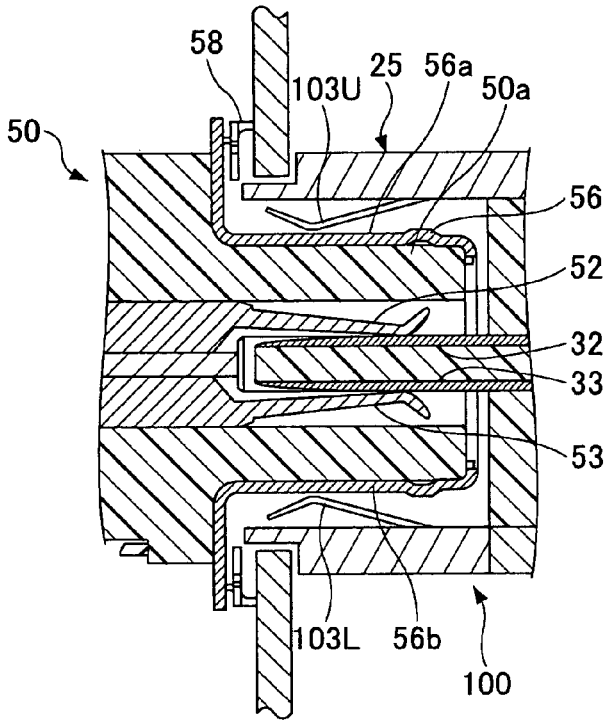
FIG. 7B is a diagram showing the plug-side connector of FIG. 3 connected to the jack-side connector according to the first embodiment of the present invention.

FIG. 4 is an enlarged cross-sectional view of an end part of the plug-side connector 100. FIG. 5 is an exploded view of the plug-side connector 100. FIG. 6 is a diagram showing the leaf spring member 101U in a fixed state with the upper cover 21 being turned upside down. FIGS. 7A and 7B are diagrams for illustrating connection of the plug-side connector 100 to the jack-side connector 50.

The plug-side connector 100 includes the zinc die-cast housing 23 and the contact assembly 30 incorporated therein. The housing 23 includes the upper cover 21 and the lower cover 22. The plug-side connector 20 is provided at an end of the cable 40. The contact assembly 30 has the contact members 32 and 33 arranged and attached to the insulating block 31. The latch claw 27 is provided on each of the X1 and X2 sides of the housing 23. The frame part 25 provided at an end of the housing 23 is part of the upper cover 21, and has an upper crosspiece part 26U and a lower crosspiece part 26L.

The electromagnetic shield leaf spring member 101U is manufactured by pressing a metal plate of a copper alloy. The leaf spring member 101U includes a U-shaped frame part 102U and multiple leaf spring pieces 103U serving as first leaf spring pieces. The leaf spring pieces 103U are arranged like comb teeth at a predetermined pitch p on the frame part 102U so as to extend therefrom. The pitch p, which is a few millimeters, is a dimension enabling formation of an electromagnetic shield.

As shown in FIGS. 3, 4, and 6, this leaf spring member 101U has the frame part 102U fitted to corresponding slits 28 formed on the interior side of the upper crosspiece part 26U, thereby fixing the frame part 102U to the interior side of the upper crosspiece part 26U. The leaf spring pieces 103U are arranged in the width directions (X1-X2 directions) of the housing 23 with their free ends oriented in the Y1 direction, that is, facing toward the ends of the housing 23 and the plug-side connector 100.

Like the above-described upper electromagnetic shield leaf spring member 101U, the lower electromagnetic shield leaf spring member 101L includes a U-shaped frame part 102L and multiple leaf spring pieces 103L serving as the first leaf spring pieces. The leaf spring pieces 103L are arranged like comb teeth at the predetermined pitch p on the frame part 102L so as to extend therefrom. As shown in FIG. 4 the leaf spring member 101L is fixed to the interior side of the lower crosspiece part 26L of the frame part 25. The leaf spring pieces 103L are arranged in the width directions (X1-X2 directions) of the housing 23 with their free ends oriented in the Y1 direction, that is, facing toward the end of the housing 23.

This plug-side connector 100 is connected to the jack-side connector 50 as shown in FIGS. 7A and 7B. That is, the contact members 32 and 33 are connected to the contact members 52 and 53, respectively, the latch claws 27 are engaged with the corresponding metallic lock parts 54, the frame part 25 is around the projecting part 50*a*, and the leaf spring pieces 103U and 103L are bent so as to be in elastic contact with an upper surface 56*a* and a lower surface 56*b*, respectively, of the electromagnetic shield cover member 56.

Between the frame part 25 and the projecting part 50*a*, the leaf spring pieces 103U and 103L are arranged at the above-described pitch p in contact with the electromagnetic shield cover member 56 so as to form an electromagnetic shield. As a result, electromagnetic noise is prevented from leaking out from and external electromagnetic noise is prevented from entering the part where the plug-side connector 100 is connected to the jack-side connector 50.

For example, even if the cable 40 is unnecessarily pulled to pry or move the plug-side connector 100 during operations such as system maintenance, the leaf spring pieces 103U and 103L are bent so as to maintain their contact with the electromagnetic shield cover member 56. Accordingly, the electromagnetic shield between the frame part 25 and the projecting part 50*a* is prevented from being broken so as to prevent leakage and entrance of electromagnetic noise.

Second Embodiment

Figure 8:
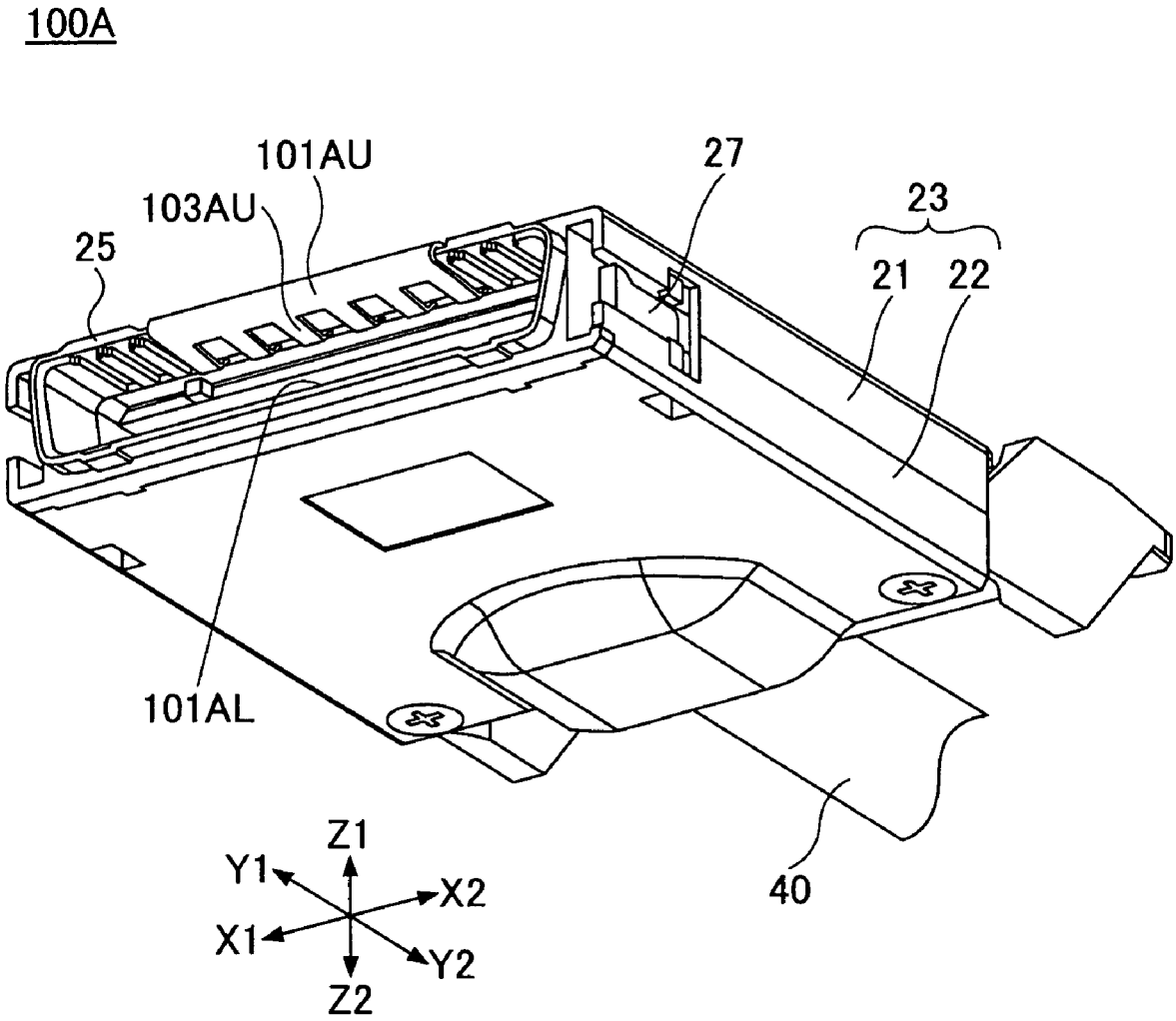
FIG. 8 is a perspective view of a plug-side connector according to a second embodiment of the present invention.
Figure 9:
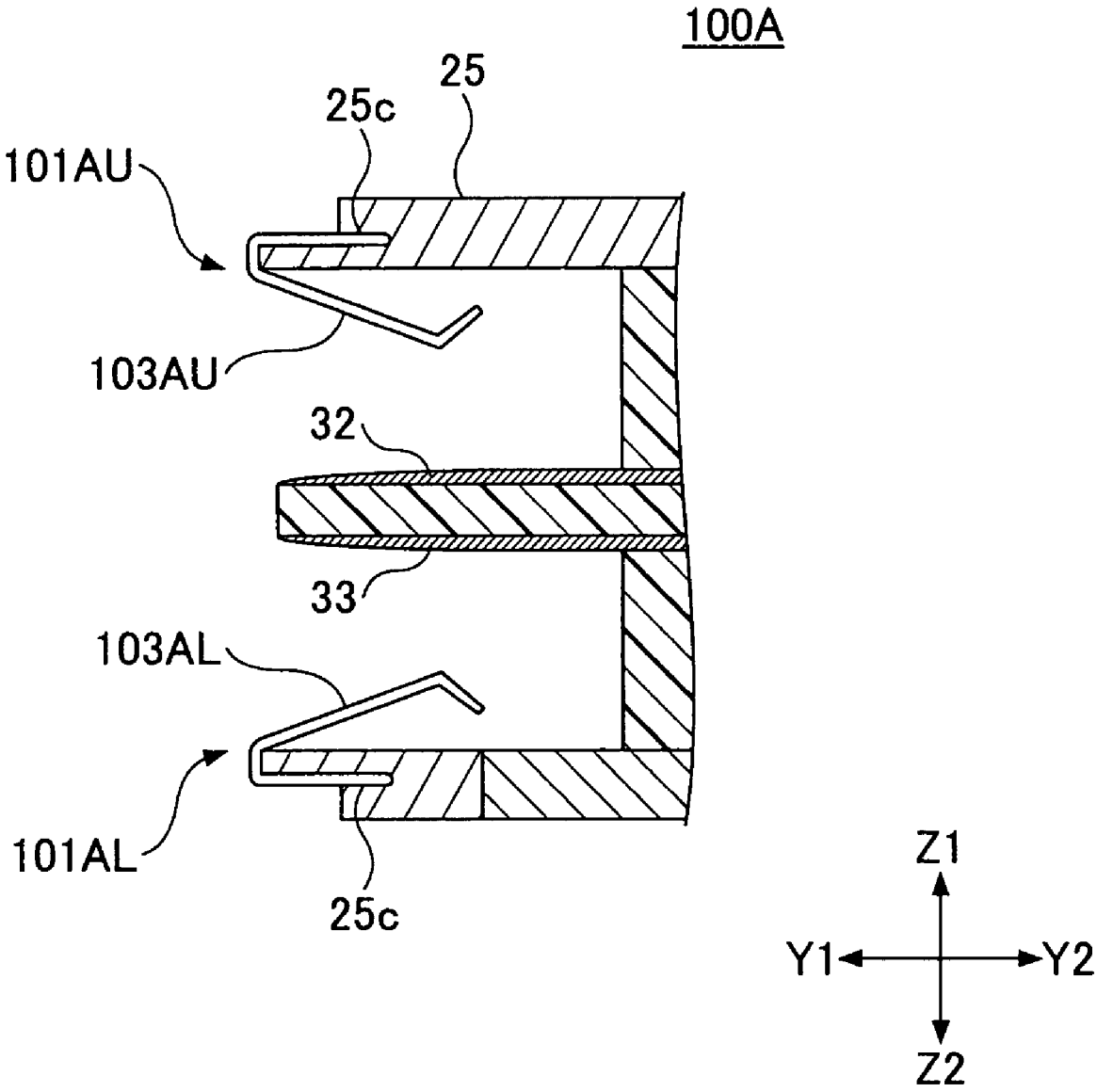
FIG. 9 is an enlarged cross-sectional view of an end part of the plug-side connector of FIG. 8 according to the second embodiment of the present invention.

FIGS. 8 and 9 are diagrams showing a plug-side connector 100A according to a second embodiment of the present invention.

The plug-side connector 100A includes conductive electromagnetic shield leaf spring members 101AU and 101AL serving as leaf spring members for a plug-side electromagnetic shield in place of the above-described electromagnetic shield leaf spring members 101U and 101L. The electromagnetic shield leaf spring members 101AU and 101AL are attached to the frame part 25, being inserted into corresponding slits 25*c* at the end of the frame part 25 so as to be around the end of the frame part 25. Comb teeth-like leaf spring pieces 103AU and 103AL serving as first leaf spring pieces have their ends oriented in the Y2 direction, that is, facing toward the inside of the housing 23 and the plug-side connection 100A.

This plug-side connector 100A is connected to the jack-side connector 50 with the leaf spring pieces 103AU and 103AL being in elastic contact with the upper surface 56*a* and the lower surface 56*b*, respectively, of the electromagnetic shield cover member 56 of the jack-side connector 50. Accordingly, even if the plug-side connector 101A is moved, the electromagnetic shield is prevented from being broken, so that leakage and entrance of electromagnetic noise are prevented.

Third Embodiment

Figure 10:
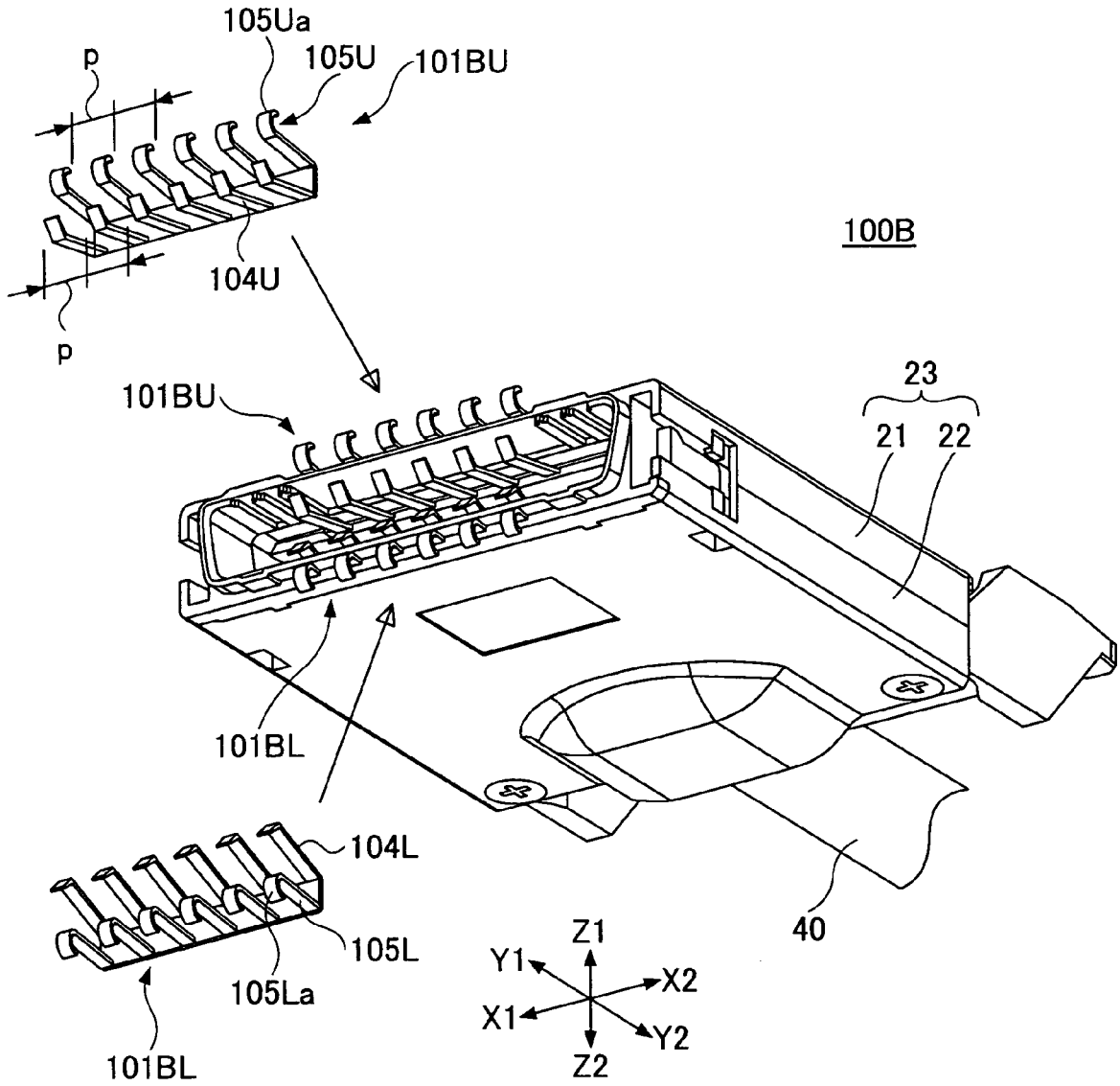
FIG. 10 is a perspective view of a plug-side connector according to a third embodiment of the present invention.
Figure 11:
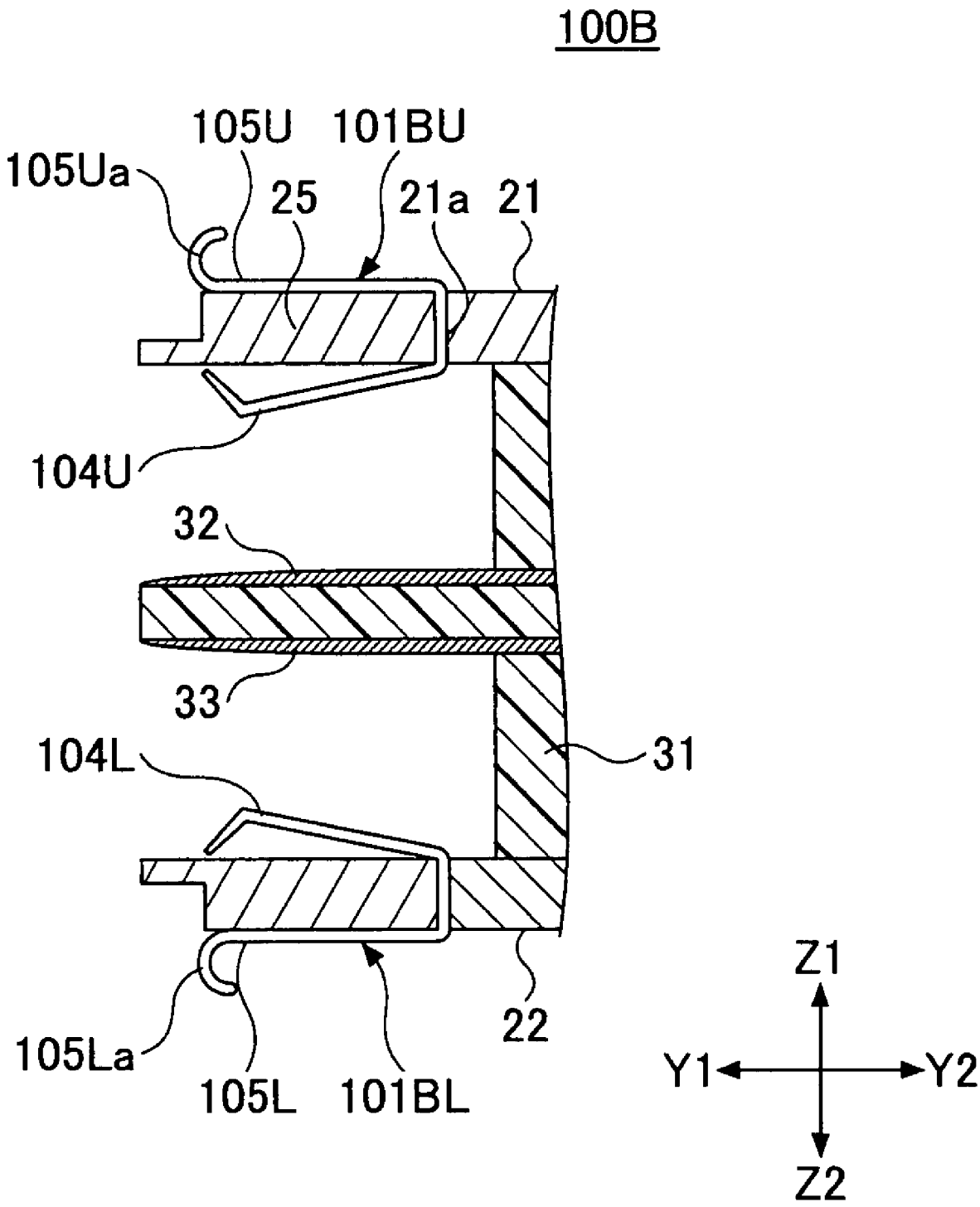
FIG. 11 is an enlarged cross-sectional view of an end part of the plug-side connector of FIG. 10 according to the third embodiment of the present invention.

FIGS. 10 and 11 are diagrams showing a plug-side connector 100B according to a third embodiment of the present invention.

The plug-side connector 100B includes conductive electromagnetic shield leaf spring members 101BU and 101BL serving as leaf spring members for a plug-side electromagnetic shield in place of the above-described electromagnetic shield leaf spring members 101U and 101L. The electromagnetic shield leaf spring members 101BU and 101BL are fixed to the frame part 25. The counterpart of connection of this plug-side connector 100B is the jack-side connector 50 shown in FIG. 1.

The leaf spring member 101BU is manufactured by pressing a metal plate of a copper alloy. The leaf spring member 101BU includes substantially V-shaped leaf spring pieces 104U serving as first leaf spring pieces and substantially J-shaped leaf spring pieces 105U serving as second leaf spring pieces. Both the leaf spring pieces 104U and the leaf spring pieces 105U are arranged like comb teeth at a pitch p. Each leaf spring piece 105U has an arc end part (arc part) 105Ua.

This leaf spring member 101BU is fixed to the upper cover 21 through a slit 21*a* thereof. The leaf spring pieces 104U are arranged on the interior side of the upper crosspiece part 26U of the frame part 25, and the leaf spring pieces 105U are arranged on the exterior side of the upper crosspiece part 26U of the frame part 25. The arc parts 105Ua are arranged on the end side of the plug-side connector 100B.

Like the above-described leaf spring member 101BU, the other leaf spring member 101BL includes substantially V-shaped leaf spring pieces 104L serving as the first leaf spring pieces and substantially J-shaped leaf spring pieces 105L serving as the second leaf spring pieces. Both the leaf spring pieces 104L and the leaf spring pieces 105L are arranged like comb teeth at a pitch p. Each leaf spring piece 105L has an arc end part (arc part) 105La.

This leaf spring member 101BL is fixed, being held between the front (Y1) end of the lower cover 22 and the rear (Y2) end of the frame part 25. The leaf spring pieces 104L are arranged on the interior side of the lower crosspiece part 26L of the frame part 25, and the leaf spring pieces 105L are arranged on the exterior side of the lower crosspiece part 26L of the frame part 25. The arc parts 105La are arranged on the end side of the plug-side connector 100B.

The arc parts 105Ua and the arc parts 105La are positioned so as to be pressed against the panel 81 of the server unit 80 when the plug-side connector 100B is connected to the jack-side connector 50.

Figure 12A:
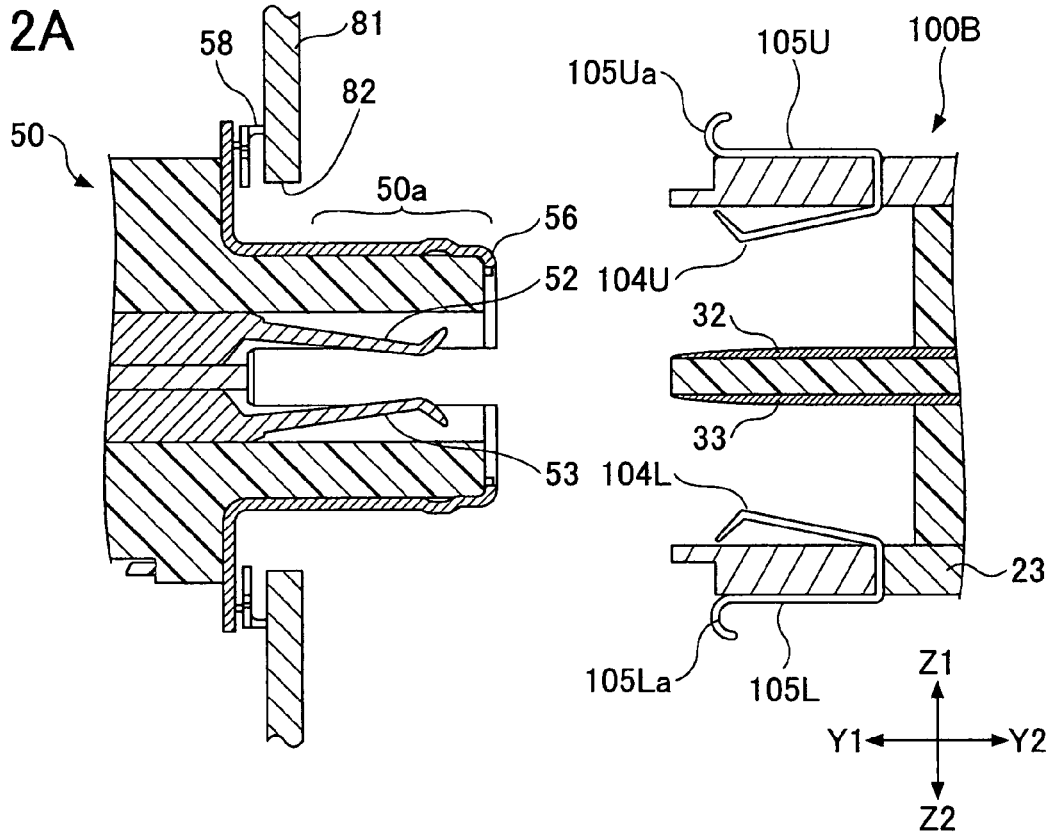
FIG. 12A is a diagram showing the plug-side connector of FIG. 10 and the jack-side connector face to face with each other.
Figure 12B:
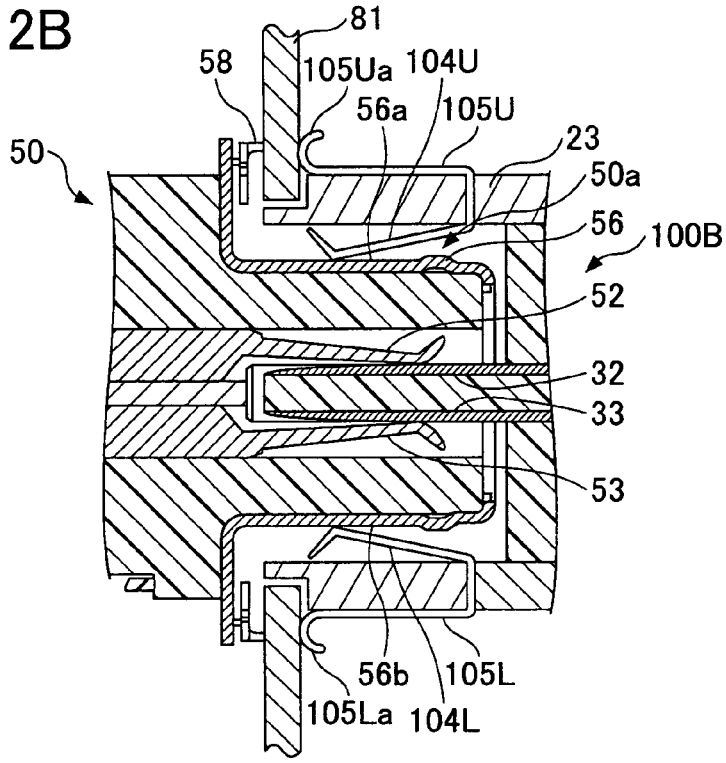
FIG. 12B is a diagram showing the plug-side connector of FIG. 10 connected to the jack-side connector according to the third embodiment of the present invention.

The above-described plug-side connector 100B is connected to the jack-side connector 50 as shown in FIGS. 12A and 12B. That is, the contact members 32 and 33 are connected to the contact members 52 and 53, respectively, the latch claws 27 are engaged with the corresponding metallic lock parts 54, the frame part 25 is around the projecting part 50*a*, the leaf spring pieces 104U and 104L are bent so as to be in elastic contact with the upper surface 56*a* and the lower surface 56*b*, respectively, of the electromagnetic shield cover member 56, and the arc end parts 105Ua and 105La of the leaf spring pieces 105U and 105L are in elastic contact with corresponding parts of the panel 81 along the edge of the opening 82.

Between the frame part 25 and the projecting part 50*a*, the leaf spring pieces 104U and 104L are arranged at the above-described pitch p in contact with the electromagnetic shield cover member 56, and are configured to keep in contact with the electromagnetic shield cover member 56 even if the plug-side connector 100B is moved. Thus, even if the plug-side connector 100B is moved, the electromagnetic shield is prevented from being broken, and is provided so as to prevent electromagnetic noise from leaking out and external electromagnetic noise from entering the plug-side connector 100B.

Further, since the arc end parts 105Ua and 105La of the leaf spring pieces 105U and 105L are arranged at the above-described pitch p on the corresponding parts of the panel 81 along the edge of the opening 82, the edge of the opening 82 is electromagnetically shielded. Further, even if the plug-side connector 100B is moved in the Z1 or Z2 direction, the above-described contact of the leaf spring pieces 104U and 104L with the electromagnetic shield cover member 56 is maintained. Accordingly, even if the plug-side connector 100B is moved, the electromagnetic shield of the parts of the panel 81 along the edge of the opening 82 is maintained without being broken.

Accordingly, a double electromagnetic field free of breakage even if the plug-side connector 100B is moved is provided at the connection of the plug-side connector 100B and the jack-side connector 50. Therefore, the plug-side connector 100B has more reliability than the plug-side connection 100 of the first embodiment.

Further, the leaf spring pieces 105U and 105L form a path that electrically connects the panel 81 and the housing 23 of the plug-side connector 100B. Accordingly, the panel 81 and the plug-side connector 100B are electrically connected by not only a path going through the gasket 58, the electromagnetic shield cover member 56, and the leaf spring pieces 104U and 104L but also another path going through the leaf spring pieces 105U and 105L. Accordingly, the housing 23 is caused to be at frame ground potential with more reliability.

The leaf spring pieces 104U and 104L may be omitted from the leaf spring members 101BU and 101BL, respectively. In this case, when the plug-side connector 100B is connected to the jack-side connector 50, the arc end parts 105Ua and 105La of the leaf spring pieces 105U and 105L, respectively, are in elastic contact with the corresponding parts of the panel 81 along the edge of the opening 82. In this case, the frame part 25 is caused to have its original size so that the interior surface of the frame part 25 comes into contact with the electromagnetic shield cover member 56.

Fourth Embodiment

Figure 13:
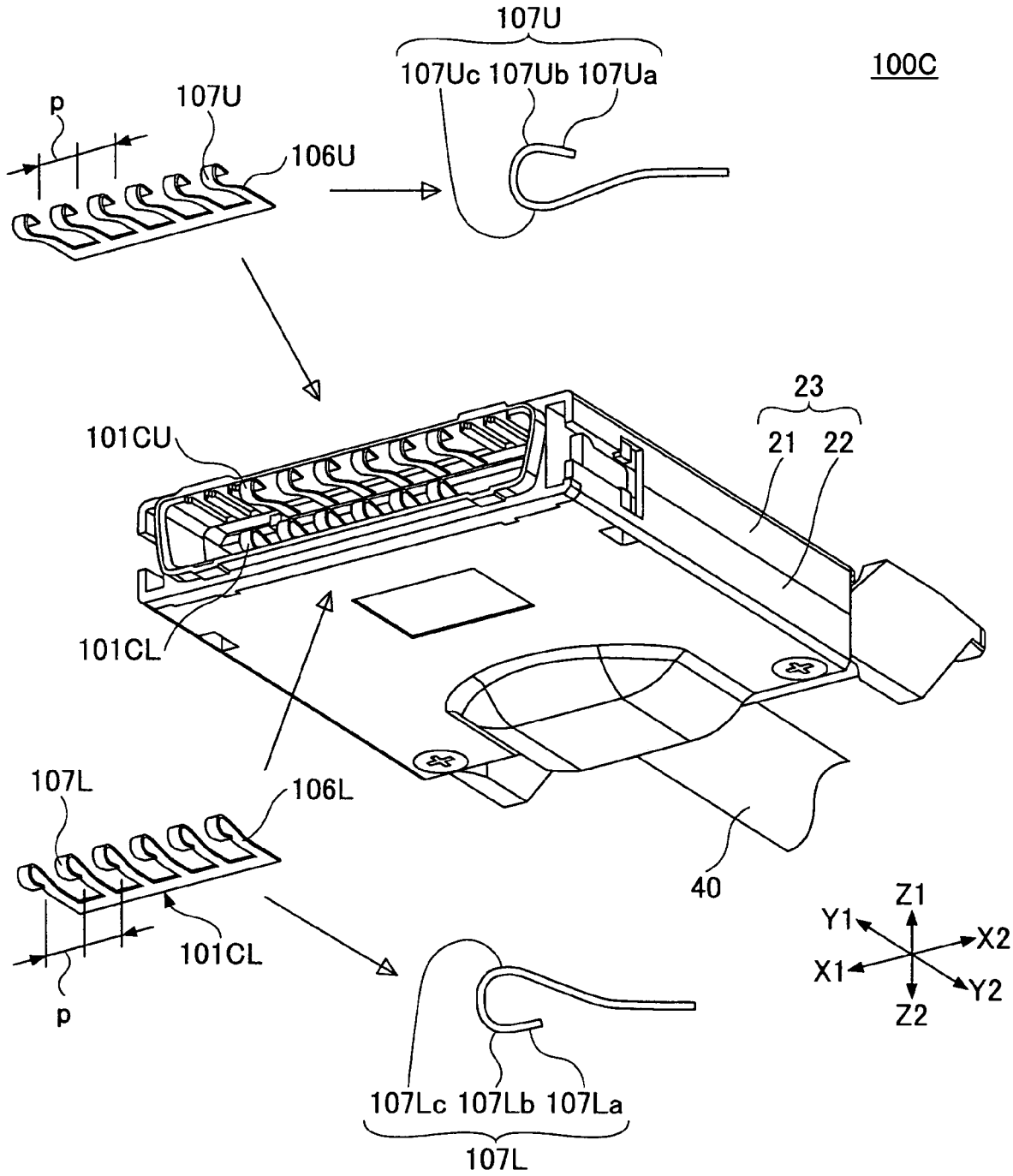
FIG. 13 is a perspective view of a plug-side connector according to a fourth embodiment of the present invention.
Figure 14:
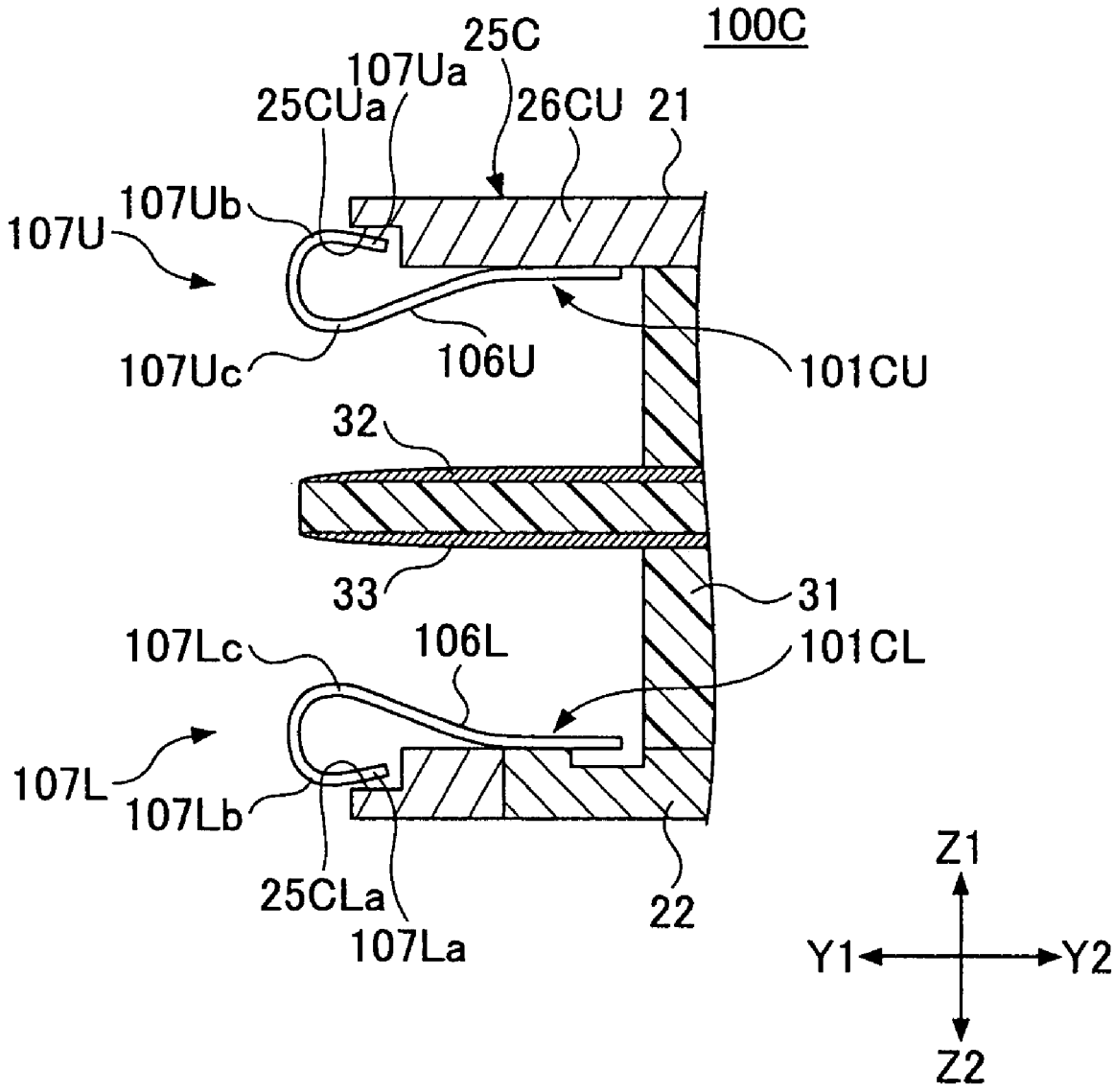
FIG. 14 is an enlarged cross-sectional view of an end part of the plug-side connector of FIG. 13 according to the fourth embodiment of the present invention.

FIGS. 13 and 14 are diagrams showing a plug-side connector 100C according to a fourth embodiment of the present invention.

The plug-side connector 100C includes conductive electromagnetic shield leaf spring members 101CU and 101CL serving as leaf spring members for a plug-side electromagnetic shield in place of the above-described leaf spring members 101BU and 101BL. The electromagnetic shield leaf spring members 101CU and 101CL are fixed to a frame part 25C. The counterpart of connection of this plug-side connector 100C is the jack-side connector 50 shown in FIG. 1.

The leaf spring member 101CU has leaf spring pieces 106U serving as first leaf spring pieces arranged like comb teeth at a pitch p. Each leaf spring piece 106U has a U-shaped end part (U-shaped part) 107U having a bulging end. The U-shaped part 107U includes an end part 107Ua, a Z1-side arc part 107Ub, and a Z2-side arc part 107Uc.

The leaf spring member 101CL has leaf spring pieces 106L serving as the first leaf spring pieces arranged like comb teeth at the pitch p. Each leaf spring piece 106L has a U-shaped end part (U-shaped part) 107L having a bulging end. The U-shaped part 107L includes an end part 107La, a Z2-side arc part 107Lb, and a Z1-side arc part 107Lc.

The frame part 25C has a shape corresponding to the above-described leaf spring members 101CU and 101LU. That is, a projecting part 25*b* of the frame part 25 in FIG. 7 is removed, and concave step parts 25CUa and 25CLa are formed along the internal edge of the end of the frame part 25C.

The leaf spring member 101CU is fixed to the lower surface of the upper cover 21, and the leaf spring pieces 106U are arranged on the lower surface of an upper crosspiece part 26CU of the frame part 25C. Each U-shaped part 107U has its end part 107Ua engaged with the concave step part 25CUa and projecting in the Y1 direction from the end of the frame part 25C.

The leaf spring member 101CL is fixed to the upper surface of the lower cover 22, and the leaf spring pieces 106L are arranged on the upper surface of a lower crosspiece part 26CL of the frame part 25C. The U-shaped parts 107L have their end parts 107La engaged with the concave step part 25CLa and projecting in the Y1 direction from the end of the frame part 25C.

The concave step parts 25CUa and 25CLa may be formed at a predetermine pitch so as to correspond to the leaf spring pieces 106U and 106L, respectively. In this case, displacement of the leaf spring pieces 106U and 106L in the X1-X2 directions (or along the X-axis) is restricted on their end side.

Figure 15A:
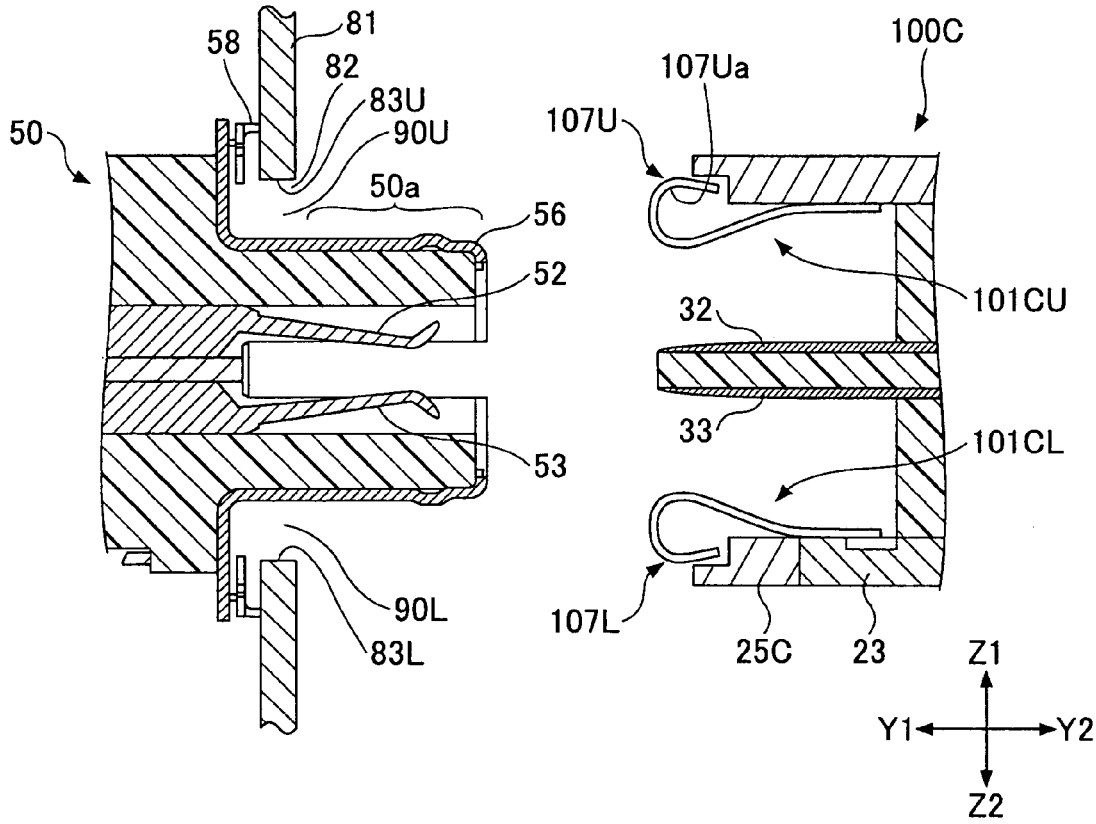
FIG. 15A is a diagram showing the plug-side connector of FIG. 13 and the jack-side connector face to face with each other.
Figure 15B:
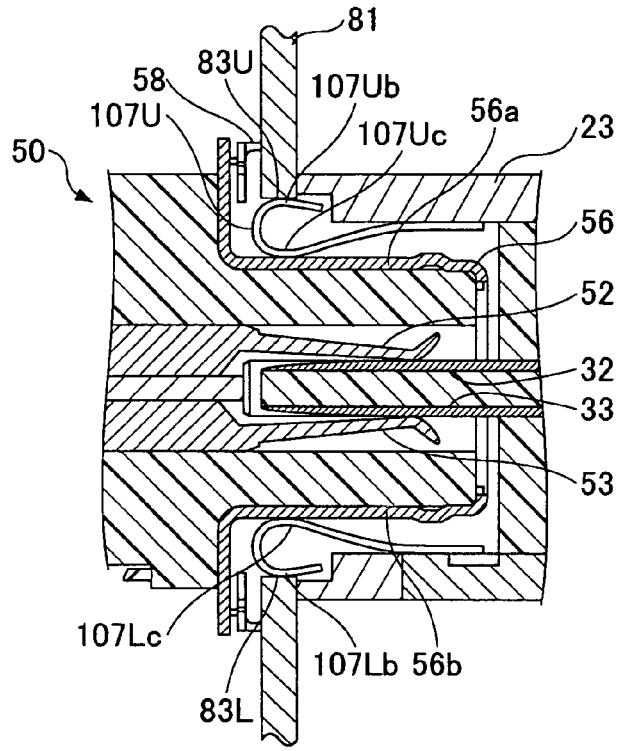
FIG. 15B is a diagram showing the plug-side connector of FIG. 13 connected to the jack-side connector according to the fourth embodiment of the present invention.

The plug-side connector 100C having the above-described configuration is connected to the jack-side connector 50 as shown in FIGS. 15A and 15B. That is, the contact members 32 and 33 are connected to the contact members 52 and 53, respectively, the latch claws 27 are engaged with the corresponding metallic lock parts 54, and the frame part 25C is around the projecting part 50*a*.

The U-shaped parts 107U of the leaf spring member 101CU slide on the upper surface 56*a* of the electromagnetic shield cover member 56 so as to be finally in a narrow gap 90U between the upper surface 56*a* of the electromagnetic shield cover member 56 and a Z1-side end face 83U of the opening 82 of the panel 81.

The U-shaped parts 107L of the leaf spring member 101CL slide on the lower surface 56*b* of the electromagnetic shield cover member 56 so as to be finally in a narrow gap 90L between the lower surface 56*b* of the electromagnetic shield cover member 56 and a Z2-side end face 83L of the opening 82 of the panel 81.

The U-shaped parts 107U and 107L are both elastically pressed. Due to the elastic forces of the U-shaped parts 107U, the arc parts 107Ub are pressed against the end face 83U and the arc parts 107Uc are pressed against the upper surface 56*a* of the electromagnetic shield cover member 56. On the other hand, due to the elastic forces of the U-shaped parts 107L, the arc parts 107Lb are pressed against the end face 83L and the arc parts 107Lc are pressed against the lower surface 56*b* of the electromagnetic shield cover member 56.

In addition to the effects produced by the above-described plug-side connector 100B shown in FIG. 9, that is, (a) the electromagnetic shield is not broken even if the plug-side connector is moved, (b) a double electromagnetic field is formed, and (c) two paths are formed to electrically connect the panel 81 and the housing 23, the plug-side connector 100C produces the following effects:

(A) the U-shaped parts 107U that have entered the gap 90U restrict the position of the upper edge of the end of the plug-side connector 100C, and the U-shaped parts 107L that have entered the gap 90L restrict the position of the lower edge of the end of the plug-side connector 100C, so that the end part of the plug-side connection is stabilized in the Z1-Z2 directions (along the Z-axis);

(B) the end parts 107Ua and 107La of the U-shaped parts 107U and 107L are fitted in the concave step parts 25CUa and 25CLa, respectively, and are not exposed to the outside. It is the arc parts of the U-shaped parts 107U and 107L that are exposed on the end side of the plug-side connector 100C. Accordingly, a user is safe from the risk of being hurt by having her/his fingertip caught by the end parts 107Ua or 107La of the U-shaped parts 107U or 107L. Further, there is no concern about unnecessary deformation of the U-shaped parts 107U or 107L during their handling.

Fifth Embodiment

Figure 16:
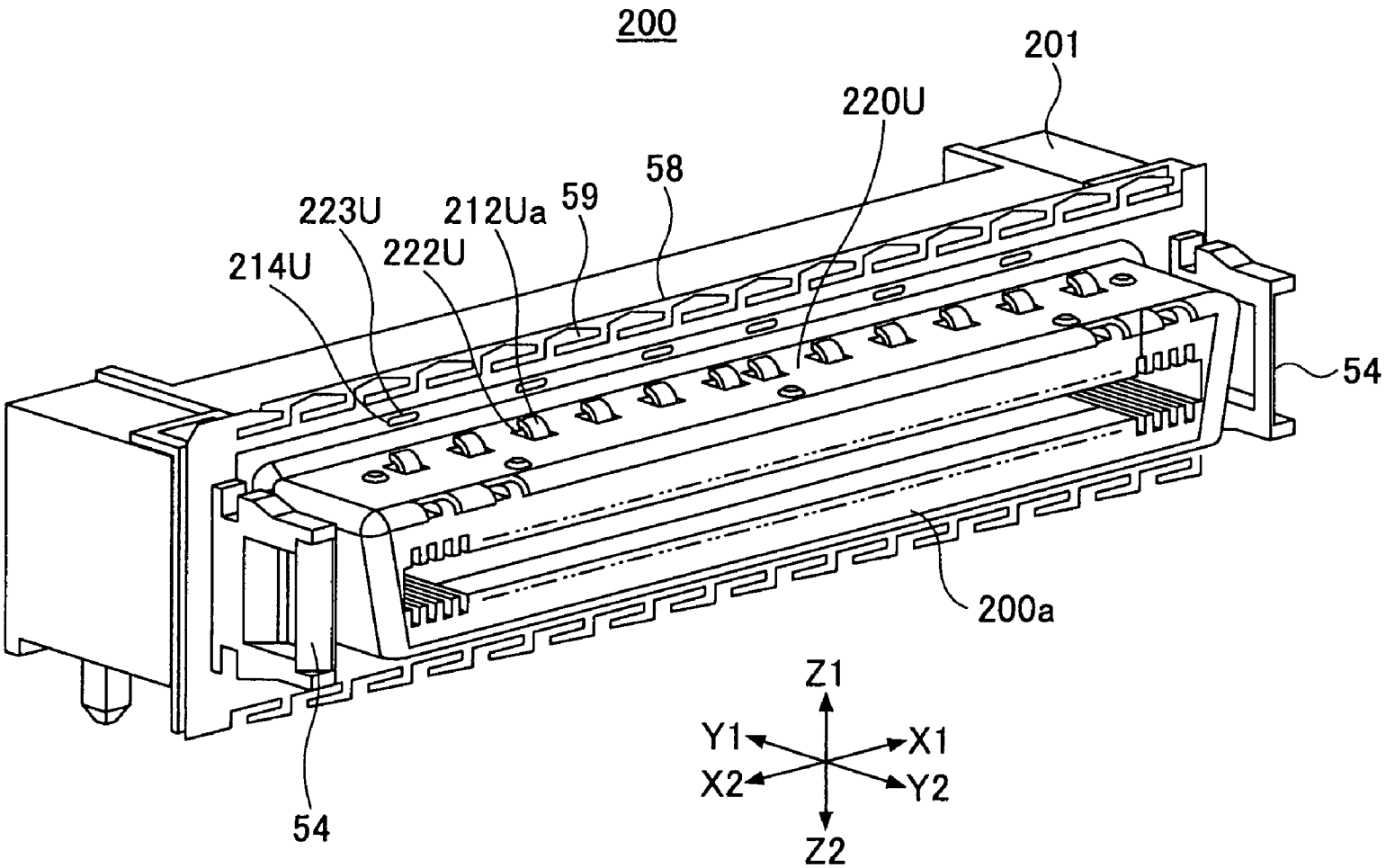
FIG. 16 is a perspective view of a jack-side connector according to a fifth embodiment of the present invention.
Figure 17:
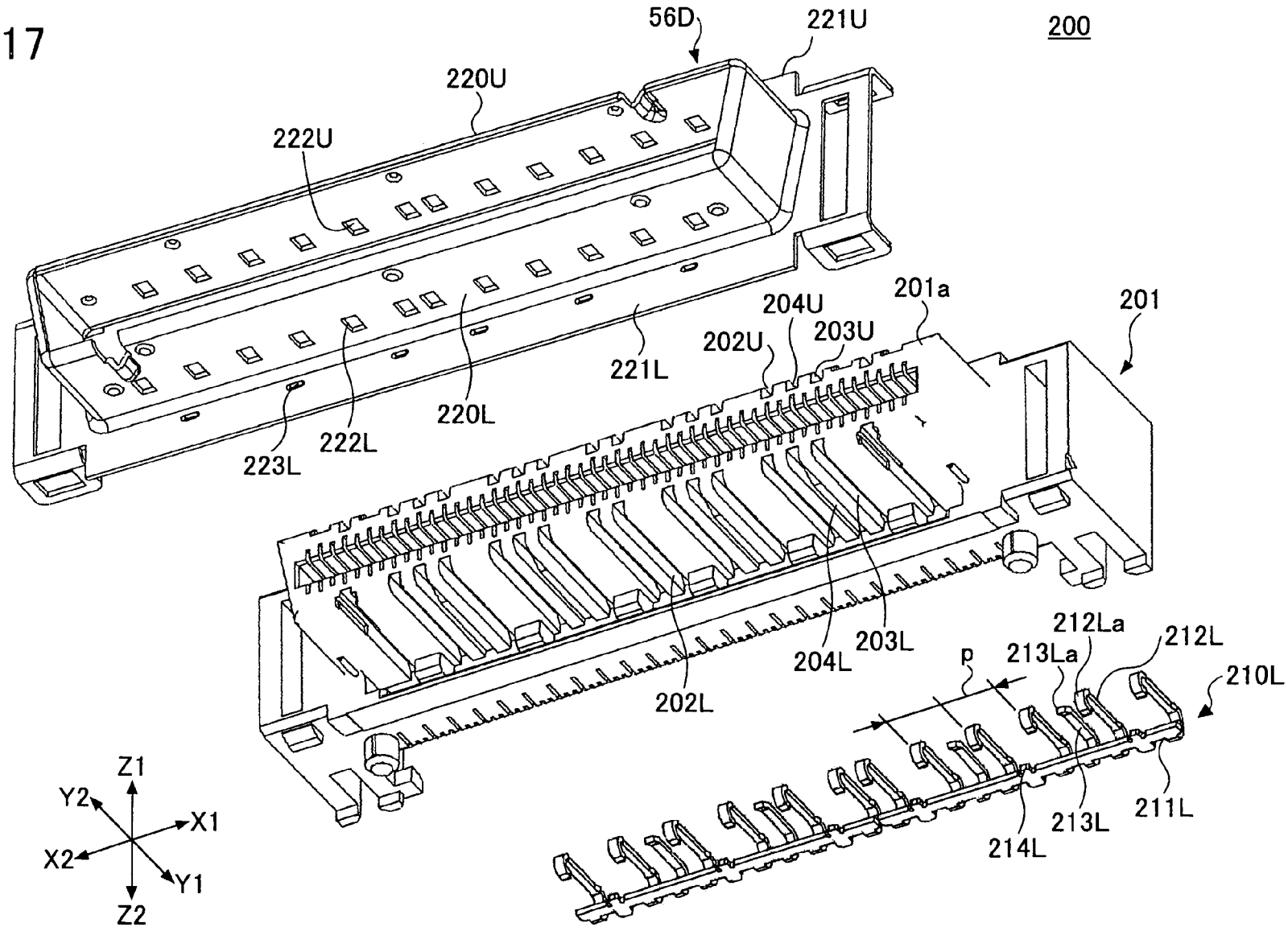
FIG. 17 is an exploded perspective view of part of the jack-side connector of FIG. 16 according to the fifth embodiment of the present invention.
Figure 18:
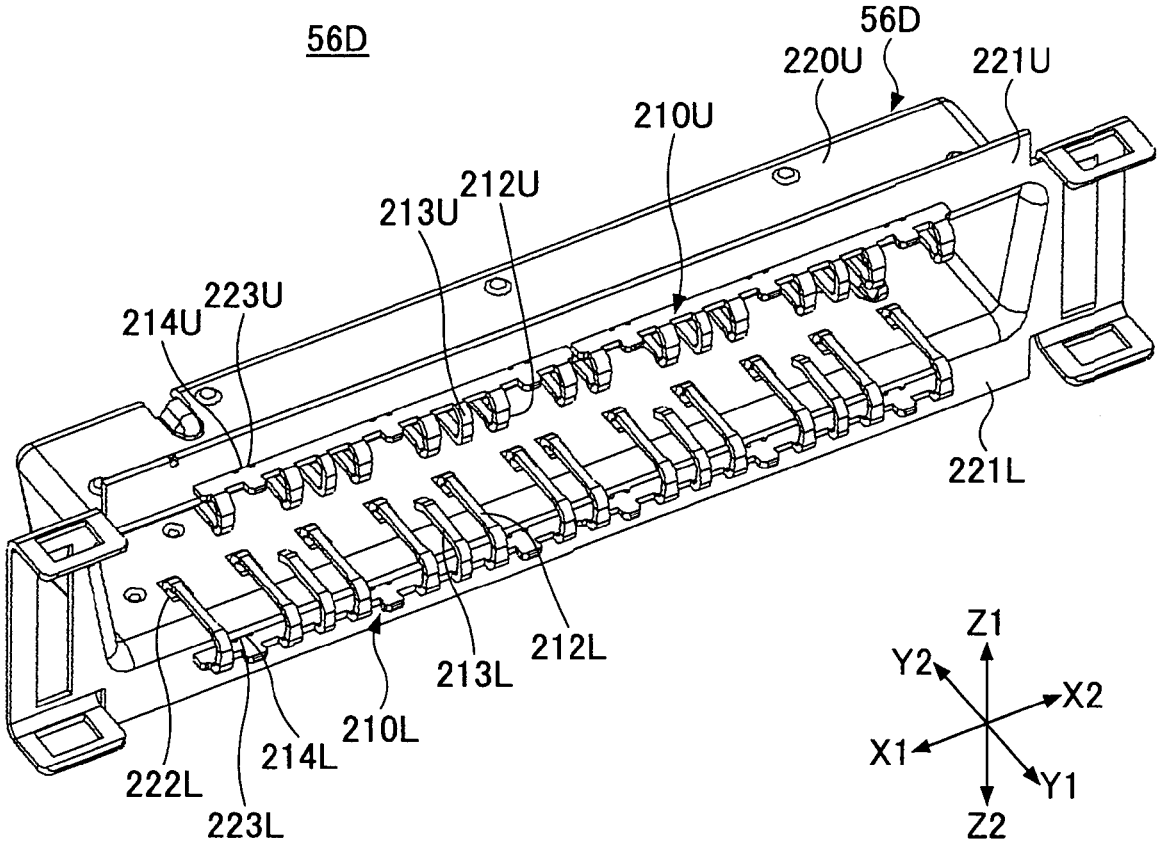
FIG. 18 is a rear view of an electromagnetic shield cover member and leaf spring members according to the fifth embodiment of the present invention.
Figure 19:
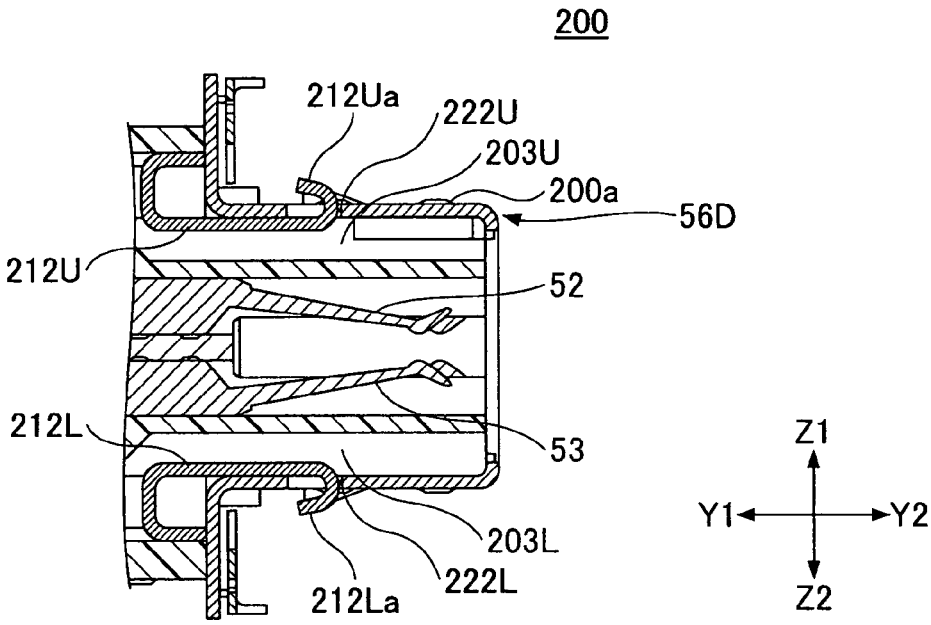
FIG. 19 is a cross-sectional view of the structure of FIG. 18, taken along a vertical plane including long leaf spring pieces according to the fifth embodiment of the present invention.
Figure 20:
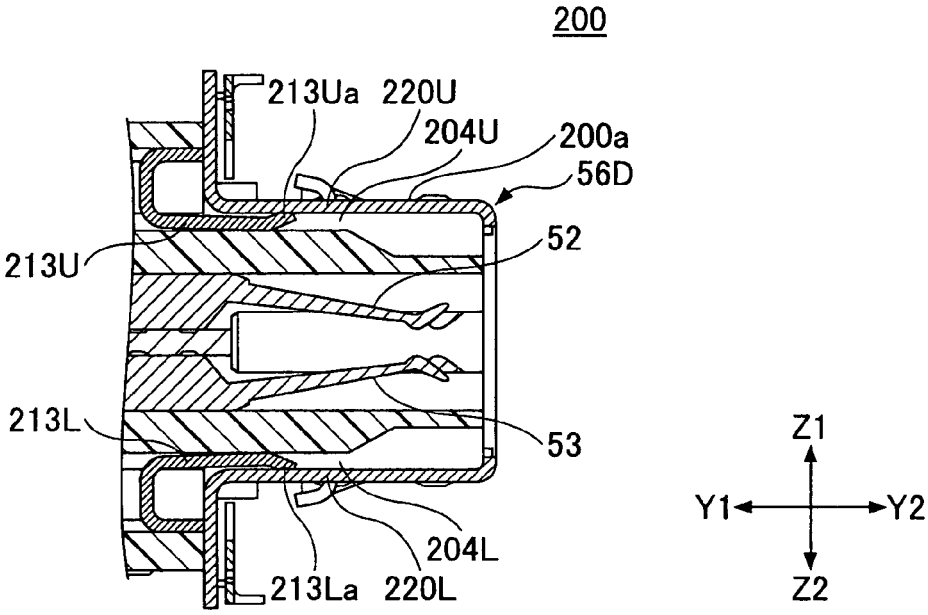
FIG. 20 is a cross-sectional view of the structure of FIG. 18, taken along a vertical plane including short leaf spring pieces according to the fifth embodiment of the present invention.

FIG. 16 is a diagram showing a jack-side connector 200 according to a fifth embodiment of the present invention. FIG. 17 is an exploded view of part of the jack-side connector 200. FIG. 18 is a rear view of an electromagnetic shield cover member 56D and electromagnetic shield leaf spring members 210U and 210L serving as leaf spring members for a jack-side electromagnetic shield. FIG. 19 is a cross-sectional view of the structure of FIG. 18, taken along a vertical plane including long leaf spring pieces 212U and 212L. FIG. 20 is a cross-sectional view of the structure of FIG. 18, taken along a vertical plane including short leaf spring pieces 213U and 213L.

The jack-side connector 200 has a substantially vertically symmetric structure. Of the components (elements) of the jack-side connector 200, those provided on the upper side (Z1 side) are referred to by numerals with a suffix U and those provided on the lower side (Z2 side) are referred to by numerals with a suffix L.

Figure 21A:
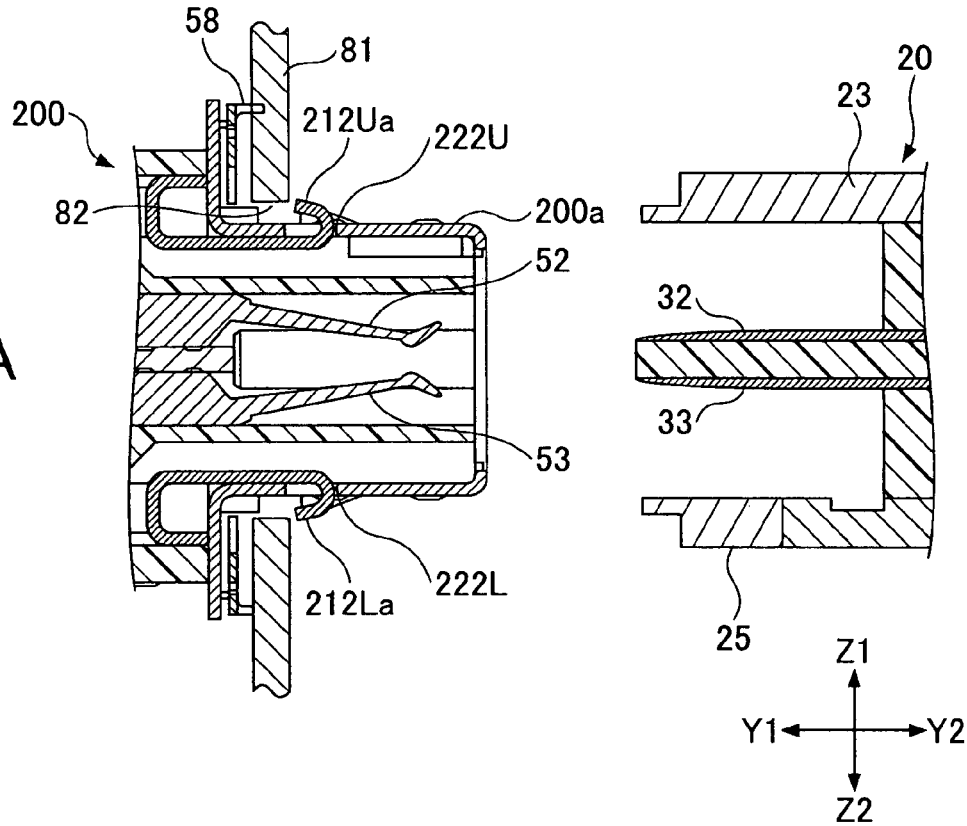
FIG. 21A is a diagram showing the plug-side connector and the jack-side connector of FIG. 16 face to face with each other.
Figure 21B:
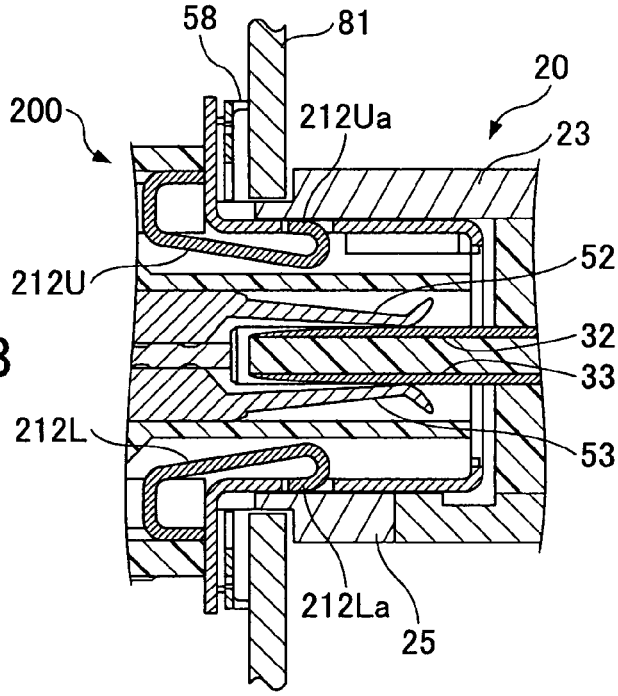
FIG. 21B is a diagram showing the plug-side connector connected to the jack-side connector of FIG. 16 according to the fifth embodiment of the present invention.

The counterpart of connection of the jack-side connector 200 is the plug-side connector shown in FIG. 1. FIGS. 21A and 21B are diagrams for illustrating connection of the plug-side connector 20 to the jack-side connector 200.

The jack-side connector 200 has the contact members 52 and 53 arranged and attached to a block formed of an insulator (an insulating block) 201. Conductive leaf spring members 210U and 210L for an electromagnetic shield are attached to the upper surface and the lower surface, respectively, of the block 201. A front-side (Y2-side) projecting part 201*a* of the block 201 and the leaf spring members 210U and 210L are covered with a carbon-steel electromagnetic shield cover member 56D having a cap-like shape. The gasket 58 is attached so as to surround this electromagnetic shield cover member 56D. The metallic lock part 54 projects in the Y2 direction from the front side of the block 201 at each of the X1 and X2 ends thereof.

The lower leaf spring member 210L is manufactured by pressing a metal plate of a copper alloy. As shown in FIG. 17, the leaf spring member 210L has a configuration where the leaf spring pieces 212L, the leaf spring pieces 213L, and projecting parts 214L in a predetermined arrangement project from a rod part 211L elongated in the X1-X2 directions like comb teeth. The leaf spring pieces 212L are arranged at a predetermined pitch p that enables formation of an electromagnetic shield.

The leaf spring pieces 212L and the leaf spring pieces 213L project from the rod part 211L in the Y1 direction so as to be curved like an arc in the Z1 direction and extend in the Y2 direction on the Z1 side of the rod part 211L. Each leaf spring piece 212L has an end part 212La curved in a U-shape in the Z2 direction. Each leaf spring piece 213L has an end part 213La curved at an angle in the Z2 direction. The projecting parts 214L project from the rod part 211L in the Y2 direction.

The upper leaf spring member 210U, which has a shape that is a mirror image of the shape of the above-described leaf spring member 210L, includes a rod part 211U, the leaf spring pieces 212U and 213U having end parts 212Ua and 213Ua, respectively, and projecting parts 214U.

Groove parts 202U and 202L, in which the upper and lower leaf spring members 210U and 210L, respectively, are fitted and accommodated, are formed in the block 201. The groove part 202U includes grooves 203U corresponding to the leaf spring pieces 212U and grooves 204U corresponding to the leaf spring pieces 213U. Likewise, the groove part 202L includes grooves 203L corresponding to the leaf spring pieces 212L and grooves 204L corresponding to the leaf spring pieces 213L.

The electromagnetic shield cover member 56D includes horizontal plate parts 220U and 220L and perpendicular plate parts 221U and 221L. Openings 222U and 222L corresponding to the above-described end parts 212Ua and 212La are formed in the horizontal plate parts 220U and 220L, respectively. Openings 223U and 223L corresponding to the projecting parts 214U and 214L are formed in the perpendicular plate parts 221U and 221L, respectively.

As shown in FIGS. 19 and 20, the leaf spring members 210U and 210L are accommodated in the groove parts 202U and 202L, respectively, so as to be inserted between the block 201 and the electromagnetic shield cover member 56D.

As shown in FIG. 18, the projecting parts 214U and 214L are fitted into the openings 223U and 223L, respectively, of the electromagnetic shield cover member 56D. As shown in FIG. 20, the leaf spring pieces 213U and 213L are in contact with the bottom surfaces of the grooves 204U and 204L, respectively, and their end parts 213Ua and 213La are elastically pressed against the interior sides of the horizontal plate parts 220U and 220L, respectively, of the electromagnetic shield cover member 56D. As shown in FIG. 19, the leaf spring pieces 212U and 212L are positioned at a distance from the bottom so as to be deformable toward the bottom in the grooves 203U and 203L, respectively. The end parts 212Ua and 212La of the leaf spring pieces 212U and 212L project through the openings 222U and 222L, respectively. The end parts 212Ua and 212La projecting through the openings 222U and 222L are arranged in the width directions (X1-X2 directions) of the jack-side connector 200.

FIG. 21A is a diagram showing the jack-side connector 200 having the above-described configuration and the plug-side connector 20 face to face with each other.

The frame part 25 of the plug-side connector 20 is fitted around a projecting part 200*a* of the jack-side connector 200, so that the contact members 32 and 33 are connected to the contact members 52 and 53, respectively, and the latch claws 27 are engaged with the corresponding metallic lock parts 54 as shown in FIG. 21B. Thereby, the plug-side connector 200 is connected to the jack-side connector 200.

As a result of the frame part 25 being fitted around the projecting part 200*a*, the end parts 212Ua and 212La are pushed inside the openings 222U and 222L, respectively, and the leaf spring pieces 212U and 212L are elastically bent, so that the spring forces of the leaf spring pieces 212U and 212L press the end parts 212Ua and 212La, respectively, against the interior surface of the frame part 25.

The elastic contact parts of the end parts 212Ua and 212La and the interior surface of the frame part 25 are arranged at a predetermined pitch p, so that an electromagnetic shield is formed where the plug-side connector 20 is connected to the jack-side connector 200. Even if the plug-side connector 20 is moved in the Z1 or Z2 direction, the end parts 212Ua and 212La remain in contact with the interior surface of the frame part 25. Thus, even if the plug-side connector 20 is moved, the electromagnetic shield is maintained without being broken.

Sixth Embodiment

Figure 22:
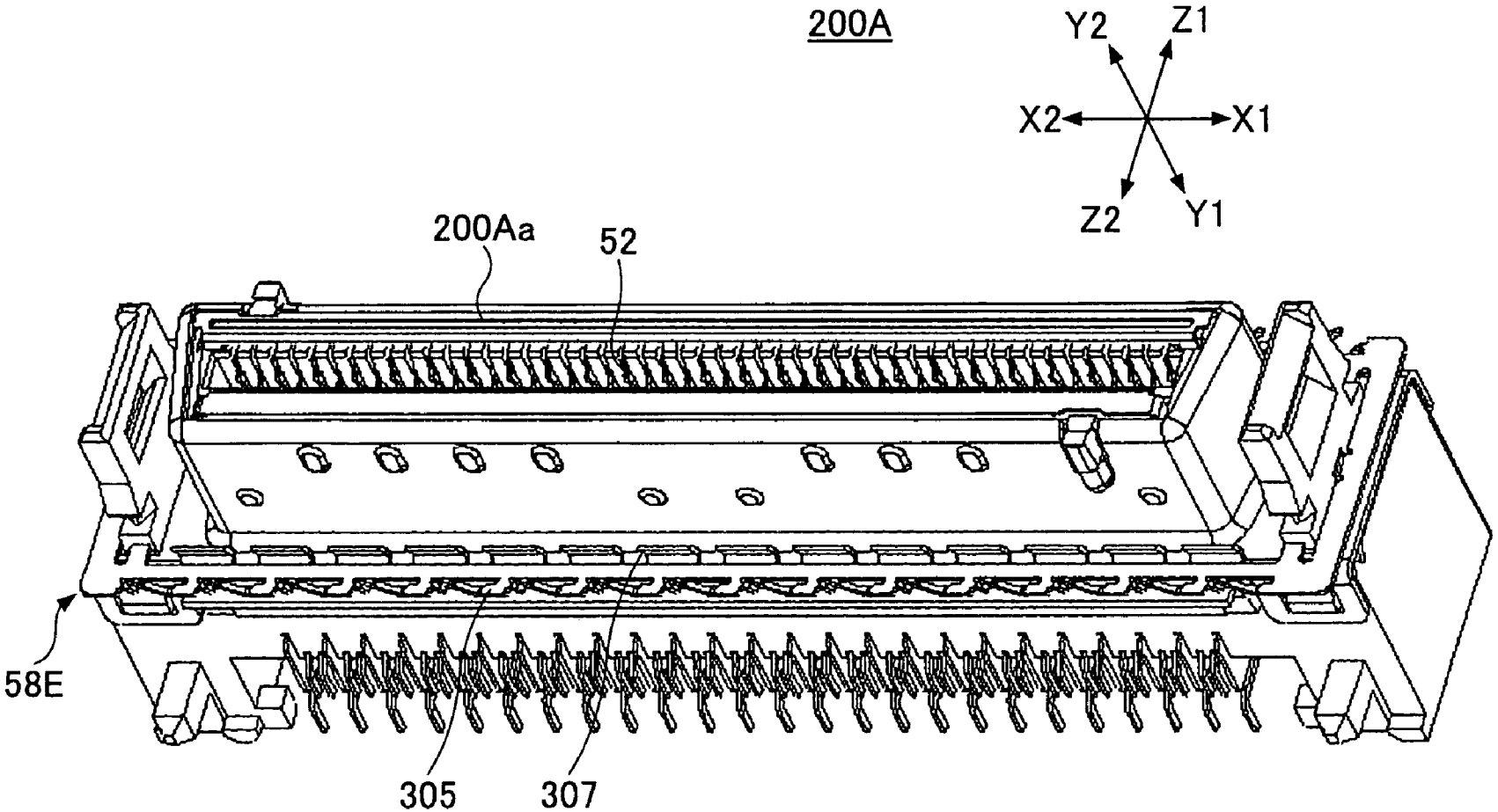
FIG. 22 is a perspective view of a jack-side connector according to a sixth embodiment of the present invention.
Figure 23:
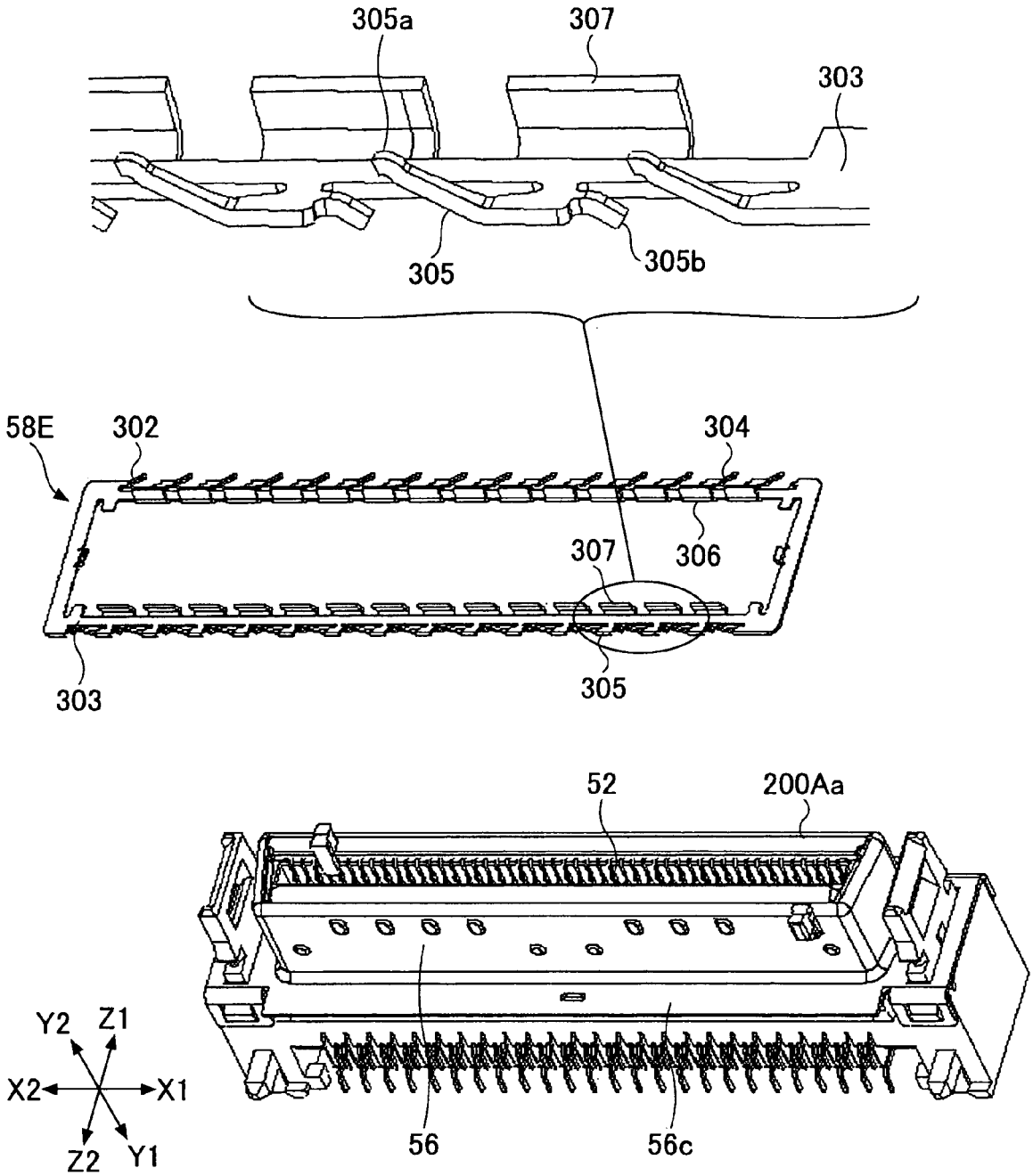
FIG. 23 is an exploded perspective view of part of the jack-side connector of FIG. 22 according to the sixth embodiment of the present invention.

FIG. 22 is a diagram showing a jack-side connector 200A according to a sixth embodiment of the present invention. FIG. 23 is an exploded view of part of the jack-side connector 200A.

Figure 24A:
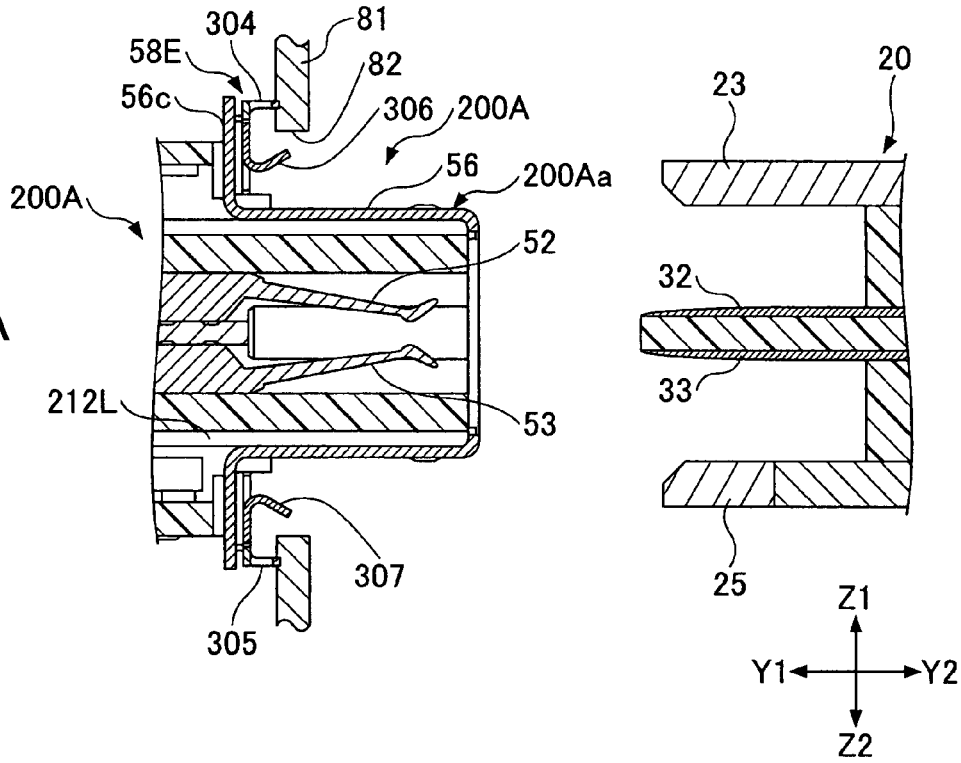
FIG. 24A is a diagram showing the plug-side connector and the jack-side connector of FIG. 22 face to face with each other.
Figure 24B:
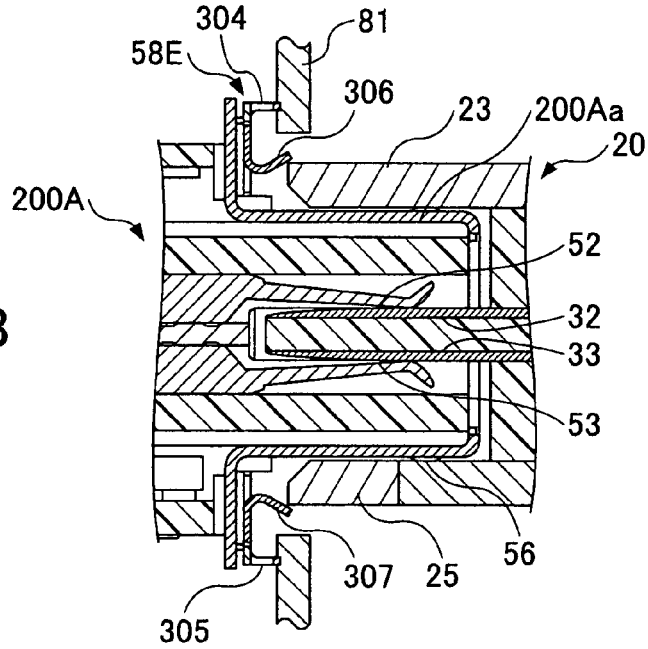
FIG. 24B is a diagram showing the plug-side connector connected to the jack-side connector of FIG. 22 according to the sixth embodiment of the present invention.

The counterpart of connection of the jack-side connector 200A is the plug-side connector 20 shown in FIG. 1. FIGS. 24A and 24B are diagrams for illustrating connection of the plug-side connector 20 to the jack-side connector 200A.

The jack-side connector 200A is different from the jack-side connector 50 shown in FIG. 1 in the configuration of a gasket. In FIGS. 22, 23, 24A and 24B, the same elements as those shown in FIG. 1 are referred to by the same reference numerals, and a description thereof is omitted.

The jack-side connector 200A includes a gasket 58E. The gasket 58E is different from the gasket 58 shown in FIG. 1 in having leaf spring pieces 306 and 307.

The gasket 58E is formed by pressing a metal plate of a copper alloy. The gasket 58E has a quadrilateral frame shape that can be fitted to a front-side projecting part 200Aa of the jack-side connector 200A. The gasket 58E includes a Z1-side side part 302 and a Z2-side side part 303. The gasket 58E is fitted to the projecting part 200Aa. Multiple leaf spring pieces 304 and 305 are formed along the exterior sides of the side parts 302 and 303, respectively, being arranged at a predetermined pitch that enables formation of an electromagnetic shield.

The leaf spring pieces 306 and 307 are formed along the interior sides of the side parts 302 and 303, respectively, being arranged at a predetermined pitch that enables formation of an electromagnetic shield. The leaf spring pieces 304 and 305 correspond to the leaf spring pieces 59 in FIG. 1. As shown enlarged in part of FIG. 23, each leaf spring piece 305 is shaped to have an X2 end part 305*a* projecting in the Y2 direction and an X1 end part 305*b* projecting in the Y1 direction. The leaf spring pieces 304 are equal in shape to the leaf spring pieces 305.

As shown enlarged in part of FIG. 23, each leaf spring piece 307 has a substantially U-letter shape, extending first in the Z1 direction from the side part 303 so as to be bent and folded back in the Y2 direction. Each leaf spring piece 307 has a quadrilateral shape when spread. The leaf spring pieces 306 are equal in shape to the leaf spring pieces 307.

The jack-side connector 200A is attached to the server unit 80 as shown in FIG. 24A. The projecting part 200Aa projects in the Y2 direction through the opening 82 of the panel (IO panel) 81. The gasket 58E is held between a flange part 56*c* of the electromagnetic shield cover member 56 and the panel 81, so that the leaf spring pieces 306 and 307 are arranged in the X1-X2 directions, projecting into the opening 82.

The plug-side connector 20 is connected to this jack-side connector 200A as shown in FIG. 24B. The frame part 25 at the end of the housing 23 is fitted around the projecting part 200Aa, and the end of the frame part 25 is pressed against the leaf spring pieces 306 and 307 so that the leaf spring pieces 306 and 307 are elastically deformed to be in contact with the end of the frame part 25 due to their elastic forces. An electromagnetic shield is formed around the exterior edge of the end of the frame part 25.

Even if the plug-side connector 20 is moved in the Z1 or Z2 direction, the leaf spring pieces 306 and 307 deform following the movement of the end of the frame part 25, so that the plug-side connector 20 remains in contact with the leaf spring pieces 306 and 307. Thus, even if the plug-side connector 20 is moved, the electromagnetic field is maintained without being broken.

Seventh Embodiment

Figure 25A:
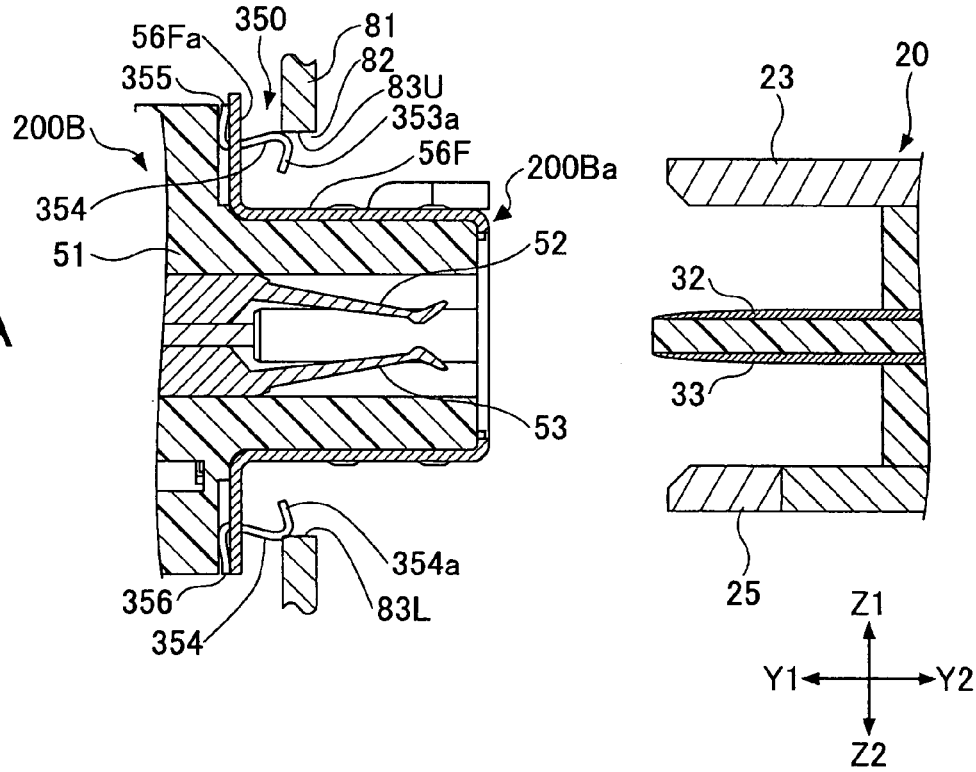
FIG. 25A is a diagram showing the plug-side connector and a jack-side connector according to a seventh embodiment of the present invention face to face with each other.

FIG. 25A is a diagram showing a jack-side connector 200B according to a seventh embodiment of the present invention. The jack-side connector 200B is different from the jack-side connector 200A shown in FIG. 22 in the gasket and the electromagnetic shield cover member.

The jack-side connector 200B is assembled by first fitting a gasket 350 and then fitting an electromagnetic shield cover member 56F to the Y2 side of the insulating block 51.

Figure 26:
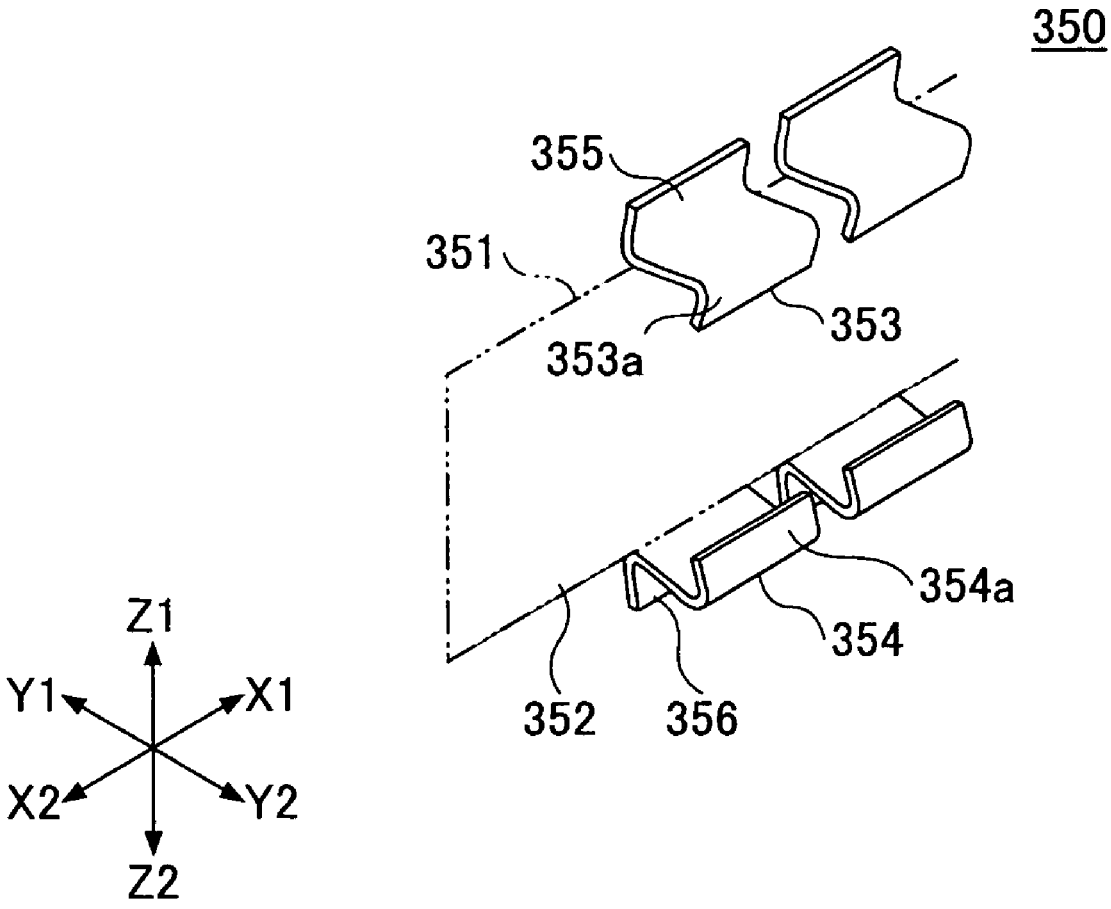
FIG. 26 is a diagram showing part of a gasket according to the seventh embodiment of the present invention.

The gasket 350 is formed of a copper alloy. As shown schematically in FIG. 26, the gasket 350 has leaf spring pieces 353 projecting in the Y2 direction and leaf spring pieces 355 projecting in the Y1 direction arranged along a side part 351 and has leaf spring pieces 354 projecting in the Y2 direction and leaf spring pieces 356 projecting in the Y1 direction arranged along a side part 352.

The leaf spring pieces 353 and 354 have respective U-shaped end parts (U-shaped parts) 353*a* and 354*a*, which are formed by being bent toward each other into a U-shape.

The electromagnetic shield cover member 56F has openings in a flange part 56Fa thereof, which openings the leaf spring pieces 353 and 354 pass through. The leaf spring pieces 355 and 356 are held between the flange part 56Fa of the electromagnetic shield cover member 56F and the block 51 so as to be in contact with the rear (Y1-side) surface of the flange part 56Fa. As shown in FIG. 25A, the jack-side connector 200B has a projecting part 200Ba thereof projecting in the Y2 direction through the opening of the panel (IO panel) 81 with the jack-side connector 200B being attached to the server unit 80. Further, the U-shaped parts 353*a* and 354*a* of the leaf spring pieces 353 and 354 project into the opening 82 so as to be in elastic contact with the end faces 83U and 83L, respectively, which are edges of the opening 82.

Figure 25B:
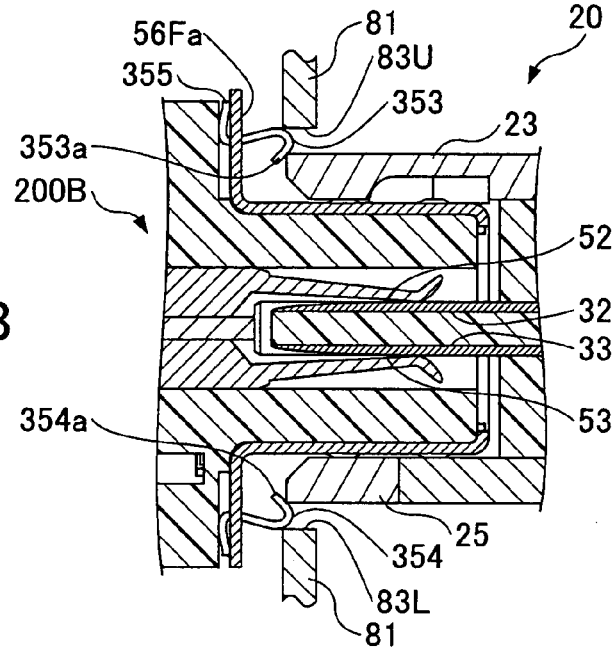
FIG. 25B is a diagram showing the plug-side connector connected to the jack-side connector according to the seventh embodiment of the present invention.

The plug-side connector 20 is connected to the jack-side connector 200B so that the frame part 25 at the end of the housing 23 are fitted around the projecting part 200Ba as shown in FIG. 25B. The end of the frame part 25 is pressed against the ends of the leaf spring pieces 353 and 354 so that their respective U-shaped parts 353*a* and 354*a* are elastically deformed in the direction in which they are pressed so as to be in contact with the end of the frame part 25 due to their elastic forces at this point. As a result, an electromagnetic shield is formed around the exterior edge of the end of the frame part 25.

Even if the plug-side connector 20 is moved, the U-shaped parts 353*a* and 354*a* of the leaf spring pieces 353 and 354 deform following the movement of the end of the frame part 25, so that the plug-side connector 20 remains in contact with the leaf spring pieces 353 and 354. Thus, even if the plug-side connector 20 is moved, the electromagnetic field is maintained without being broken.

Eighth Embodiment

Figure 27:
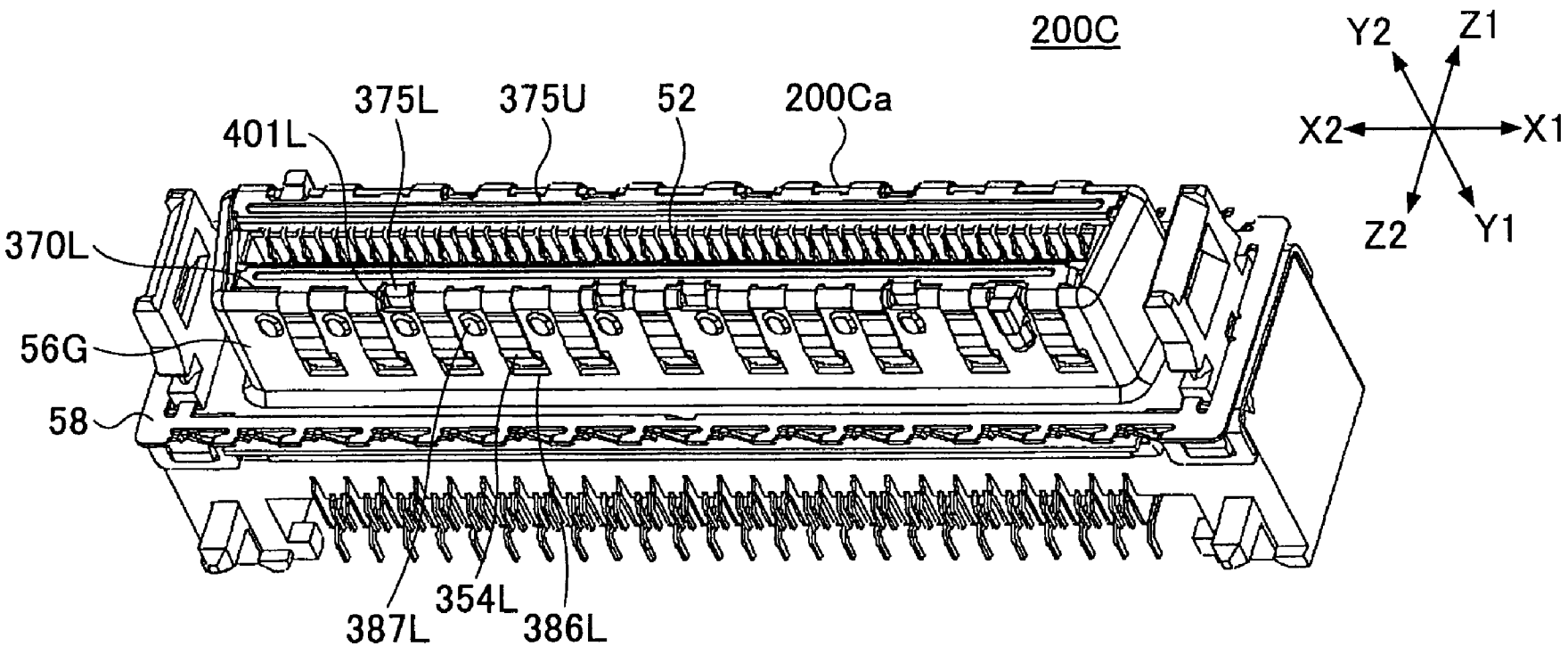
FIG. 27 is a perspective view of a jack-side connector according to an eighth embodiment of the present invention.
Figure 28:
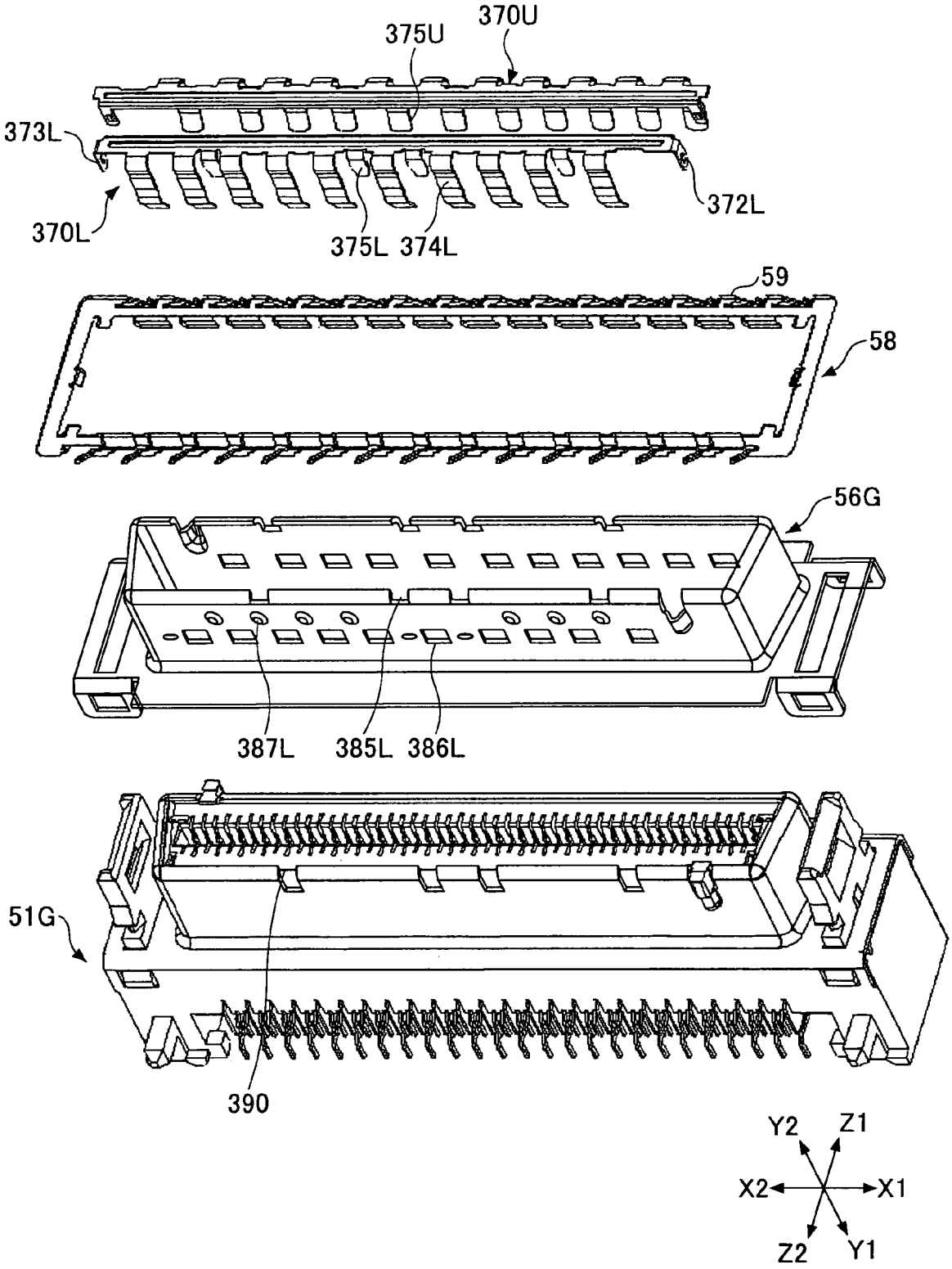
FIG. 28 is an exploded perspective view of the jack-side connector of FIG. 27 according to the eighth embodiment of the present invention.

FIG. 27 is a diagram showing a jack-side connector 200C according to an eighth embodiment of the present invention. FIG. 28 is an exploded view of the jack-side connector 200C.

Figure 32A:
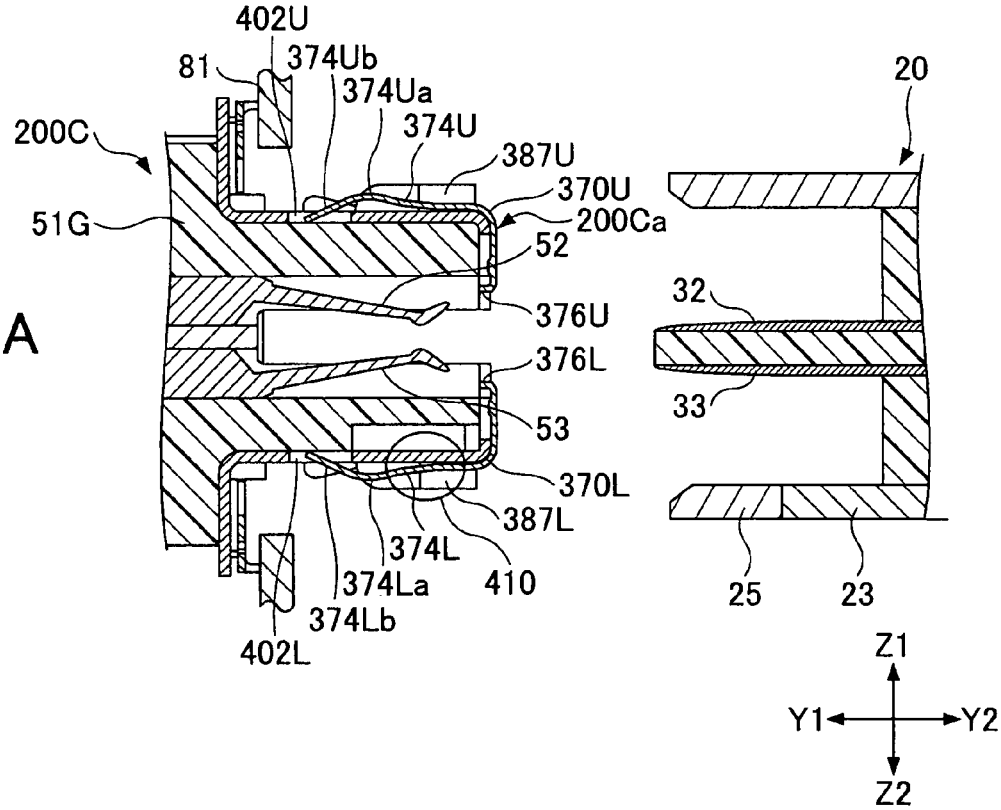
FIG. 32A is a diagram showing the plug-side connector and the jack-side connector of FIG. 27 face to face with each other.
Figure 32B:
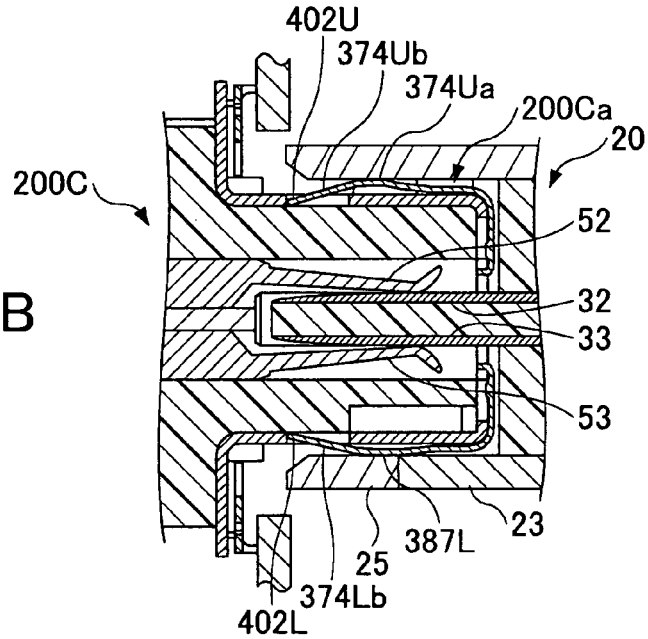
FIG. 32B is a diagram showing the plug-side connector connected to the jack-side connector of FIG. 27 according to the eighth embodiment of the present invention.

The counterpart of connection of the jack-side connector 200C is the plug-side connector 20 shown in FIG. 1. FIGS. 32A and 32B are diagrams for illustrating connection of the plug-side connector 20 to the jack-side connector 200C.

The jack-side connector 200C has a configuration where a pair of conductive electromagnetic shield leaf spring members 370U and 370L formed of a metal plate of a copper alloy as leaf spring members for a jack-side electromagnetic shield is attached to the jack-side connector 50 shown in FIG. 1 with the leaf spring members 370U and 370L being vertically spaced, and the electromagnetic shield cover member 56 in FIG. 1 is replaced with an electromagnetic shield cover member 56G. As shown in FIGS. 27 and 28, the leaf spring members 370U and 370L are attached along the upper side and the lower side of the end of a projection part 200Ca of the jack-side connector 200C.

Figure 29A:
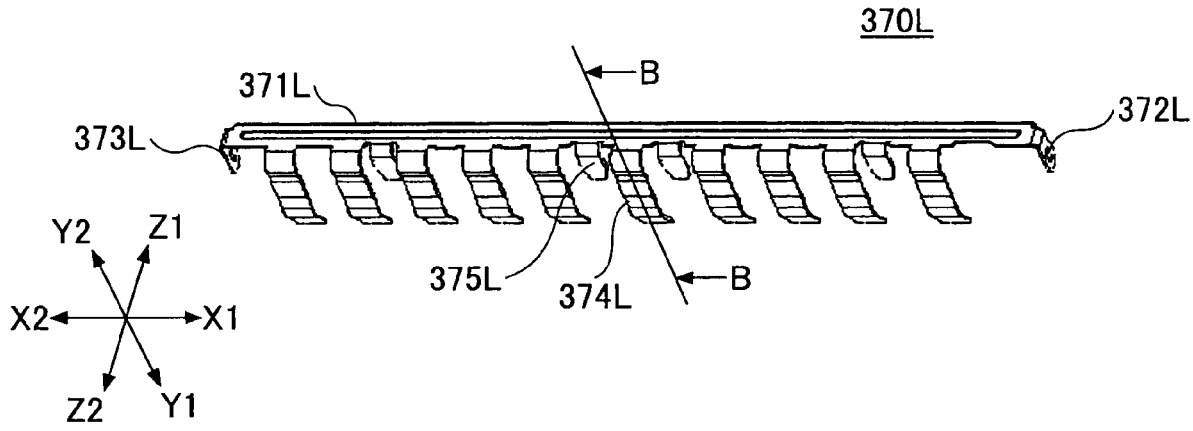
FIGS. 29A and 29B are diagrams showing a leaf spring member in FIG. 27 according to the eighth embodiment of the present invention.

As shown in FIG. 29A, the lower leaf spring member 370L has hook parts 372L and 373L, multiple leaf spring pieces 374L, and multiple lug parts 375L projecting from a long narrow crosspiece part 371L to be bent and extend in the Y1 direction. The hook parts 372L and 373L are provided at the corresponding ends of the crosspiece part 371L. The leaf spring pieces 374L and the lug parts 375L project in the Z2 direction so as to cross the crosspiece part 371L at right angles. The leaf spring pieces 374L are arranged at a predetermined pitch that enables formation of an electromagnetic shield.

Figure 29B:
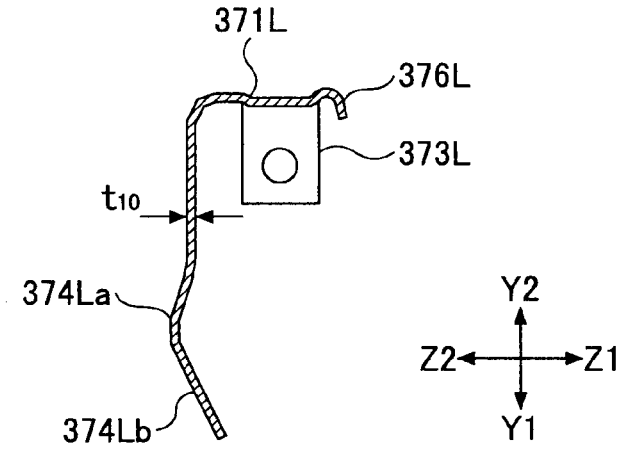

As shown in FIG. 29B, which is a cross-sectional view of the leaf spring member 370L of FIG. 29A taken along the line B-B, each leaf spring piece 374L has a thickness t10 and has a gently-curving convex part 374La near the end thereof. Further, each leaf spring piece 374L has an end part 374Lb extending at an angle from the convex part 374La. Each lug part 375L is positioned between corresponding adjacent two of the leaf spring pieces 374L. Further, the crosspiece part 371L has a bent part 376L bent in the Y1 direction at the Z1-side edge thereof.

As shown in FIG. 28, the upper leaf spring member 370U is the same as the above-described lower leaf spring member 370L, but has a different orientation. The components (elements) of the upper leaf spring member 370U are referred to by the numerals corresponding to those of the corresponding components (elements) of the lower leaf spring member 370L.

Figure 30:
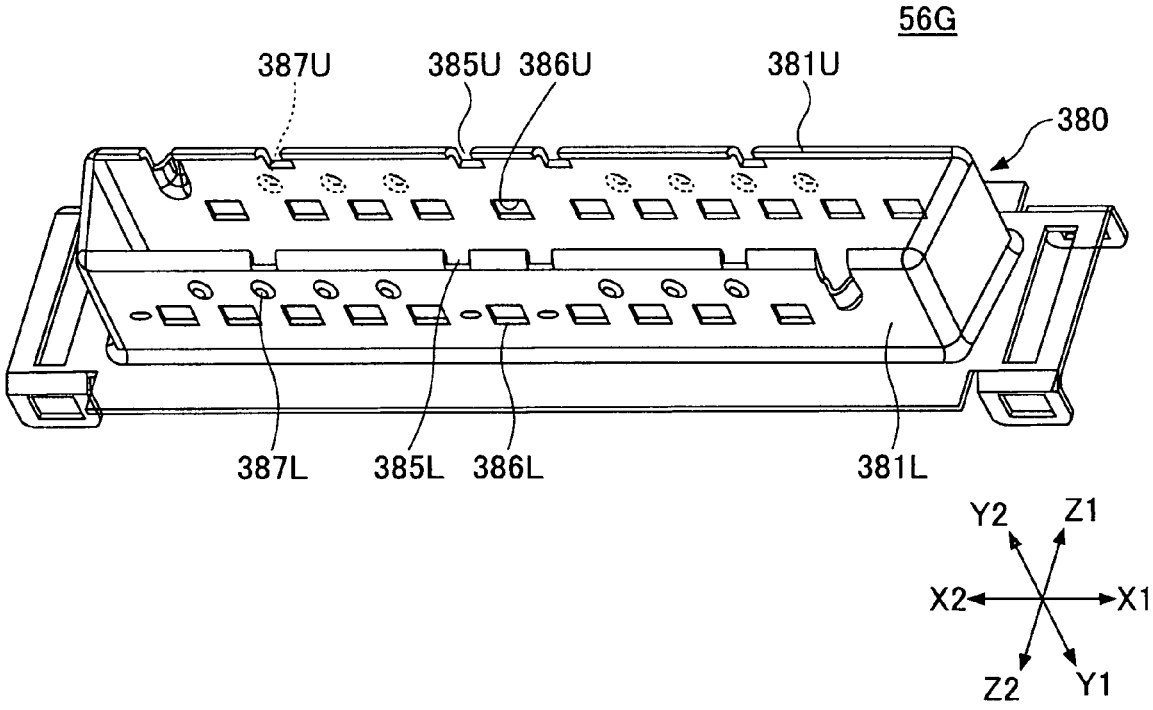
FIG. 30 is a diagram showing an electromagnetic shield cover member in FIG. 27 according to the eighth embodiment of the present invention.

Roughly speaking, the electromagnetic shield cover member 56G is formed by adding cutouts 385U and 385L, openings 386U and 386L, and projecting parts 387U and 387L to the electromagnetic shield cover member 56 of FIG. 1 as shown in FIG. 30. The cutouts 385U, the openings 386U, and the projecting parts 387U are formed in or on a Z1-side horizontal plate part 381U of a frame part 380 of the electromagnetic shield cover member 56G so as to correspond to the leaf spring member 370U. The cutouts 385L, the openings 386L, and the projecting parts 387L are formed in or on a Z2-side horizontal plate part 381L of the frame part 380 of the electromagnetic shield cover member 56G so as to correspond to the leaf spring member 370L.

The projecting parts 387U and 387L protect the leaf spring pieces 374U and 374L, respectively, by preventing the leaf spring pieces 374U and 374L from being excessively bent in directions in which the leaf spring pieces 374U and 374L are pressed (or flattened).

Figure 33:
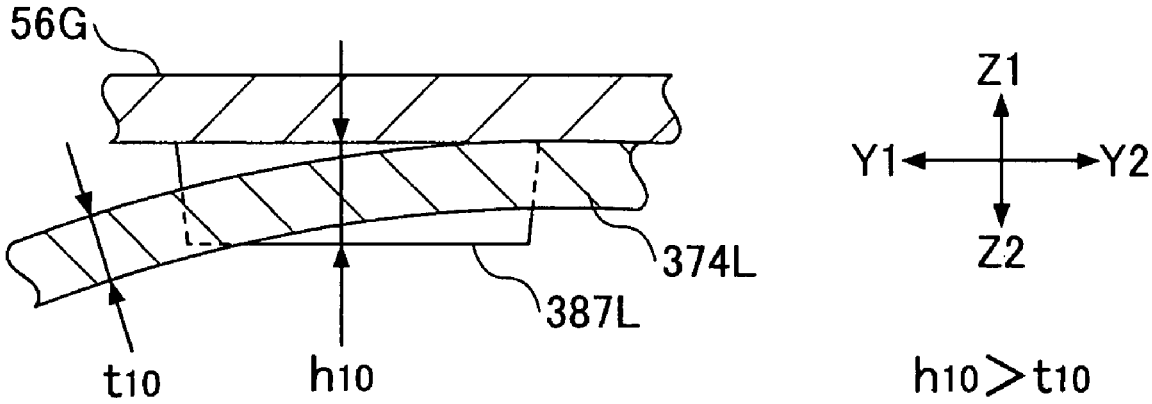
FIG. 33 is an enlarged view of a circled part in FIG. 32A according to the eighth embodiment of the present invention.

The projecting parts 387U and 387L project from the upper surface and the lower surface, respectively of the electromagnetic shield cover member 56D. Each projecting part 387U is positioned between corresponding adjacent two of the openings 386U, that is, positioned where the projecting part 387U does not interfere with any of the leaf spring pieces 374U. Each projecting part 387L is positioned between corresponding adjacent two of the openings 386L, that is, positioned where the projecting part 387L does not interfere with any of the leaf spring pieces 374L. As shown in FIG. 33, the projecting part 387L projects from the lower surface of the electromagnetic shield cover member 56G by a vertical dimension (height) h10, which is greater than the thickness t10 of the leaf spring piece 374L. FIG. 33 is an enlarged view of a circled part 410 in FIG. 32A. The same applies to the projecting parts 387U.

As shown in FIG. 28, groove parts 390 are formed in the insulating block 51G so as to correspond to the above-described lug parts 375U and 375L.

Figure 31:
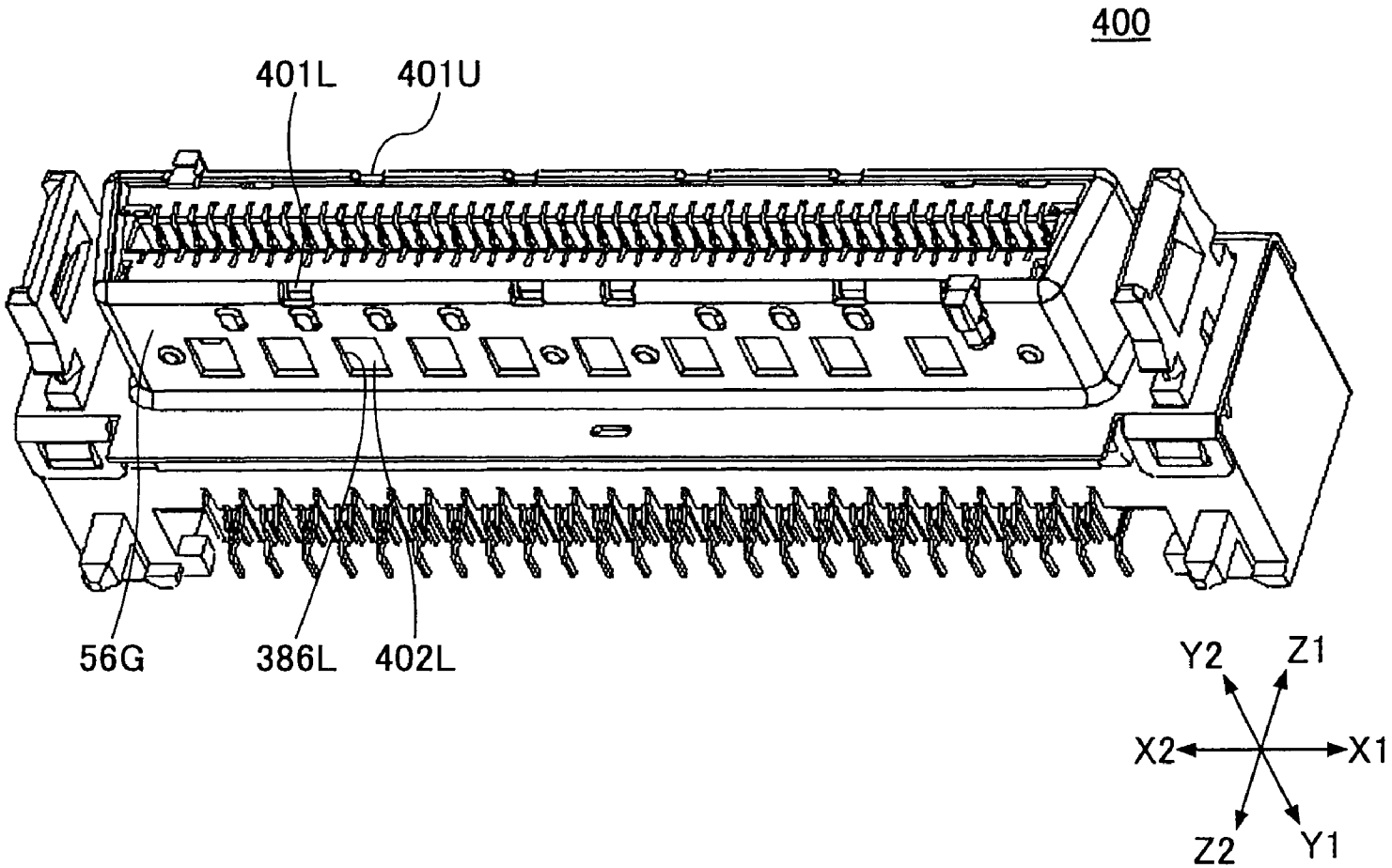
FIG. 31 is a diagram showing an assembly where the electromagnetic shield cover member is attached to a block according to the eighth embodiment of the present invention.

FIG. 31 is a diagram showing an assembly 400 where the electromagnetic shield cover member 56G is attached to the block 51G. The assembly 400 includes insertion openings 401U and 401L formed by the cutouts 385U and 385L, respectively, so that the lug parts 375U and 375L are inserted thereinto; and concave parts (or recesses) 402U (FIGS. 32A and 32B) and 402L formed by the openings 386U and 386L, respectively, so that the end parts 374Ub and 374Lb of the leaf spring pieces 374U and 374L are fitted thereto.

Referring to FIG. 27 as well as FIGS. 28 and 32A, the leaf spring member 370L is attached to the Z2-side part of the end of the projecting part of the assembly 400 with the hook parts 372L and 373L being engaged with part of the block 51G. The lug parts 375L are inserted into the corresponding groove parts 390 through the corresponding insertion openings 401L so as to be in contact with the interior side of the electromagnetic shield cover member 56G, so that the leaf spring member 370L is at the same potential as the electromagnetic shield cover member 56G.

Further, as shown also in FIG. 32A, the end parts 374Lb of the leaf spring pieces 374L are fitted into the corresponding concave parts 402L so as to, for example, prevent the ends of the leaf spring pieces 374L from catching something and rising during handling. The end parts 374Lb of the leaf spring pieces 372L are movable in the Y1 direction in the corresponding concave parts 402, and the convex parts 374La are elastically deformable in a direction in which they are pressed. The displacement of the end part 374Lb of each leaf spring piece 374L in the X1-X2 directions is restricted so as to prevent unnecessary bending of the leaf spring piece 374L.

Referring to FIG. 27 as well as FIGS. 28 and 32A, the leaf spring member 370U is attached to the Z1-side part of the end of the projecting part of the assembly 400 in the same manner as the above-described leaf spring member 370L. The leaf spring member 370U is electrically connected to the electromagnetic shield cover member 56G, and the end parts 374Ub of the leaf spring pieces 374U are fitted into the corresponding concave parts 402U.

The jack-side connector 200C having the above-described configuration is attached to the server unit 80 as shown in FIG. 32A. The plug-side connector 20 is connected to the jack-side connector 200C as shown in FIG. 32B. The interior side of the frame part 25 of the plug-side connector 20 elastically deforms the convex parts 374Ua and 374La of the leaf spring pieces 374U and 374L in directions to flatten the convex parts 374Ua and 374La. The convex parts 374Ua and 374La of the leaf spring pieces 374U and 374L are in elastic contact with the interior side of the frame part 25. As a result of these contact parts being arranged at a predetermined pitch, the connection of the plug-side connector and the jack-side connector 200C is electromagnetically shielded.

Even if the plug-side connector 20 is moved in the Z1 or Z2 direction, the convex parts 374Ua and 374La of the leaf spring pieces 374U and 374L deform following the movement of the end of the frame part 25, so that the frame part 25 remains in contact with the convex parts 374Ua and 374La. Thus, even if the plug-side connector 20 is moved, the electromagnetic field is maintained without being broken.

Further, the projecting parts 387U and 387L prevent the interior surface of the frame part 25 from excessively approaching the horizontal plate parts 381U and 381L of the electromagnetic shield cover member 56D. This prevents the leaf spring pieces 374U and 374L from being excessively bent in the directions in which they are pressed, thereby preventing the leaf spring pieces 374U and 374L from plastically deforming in the directions in which they are flattened.

Ninth Embodiment

Figure 34:
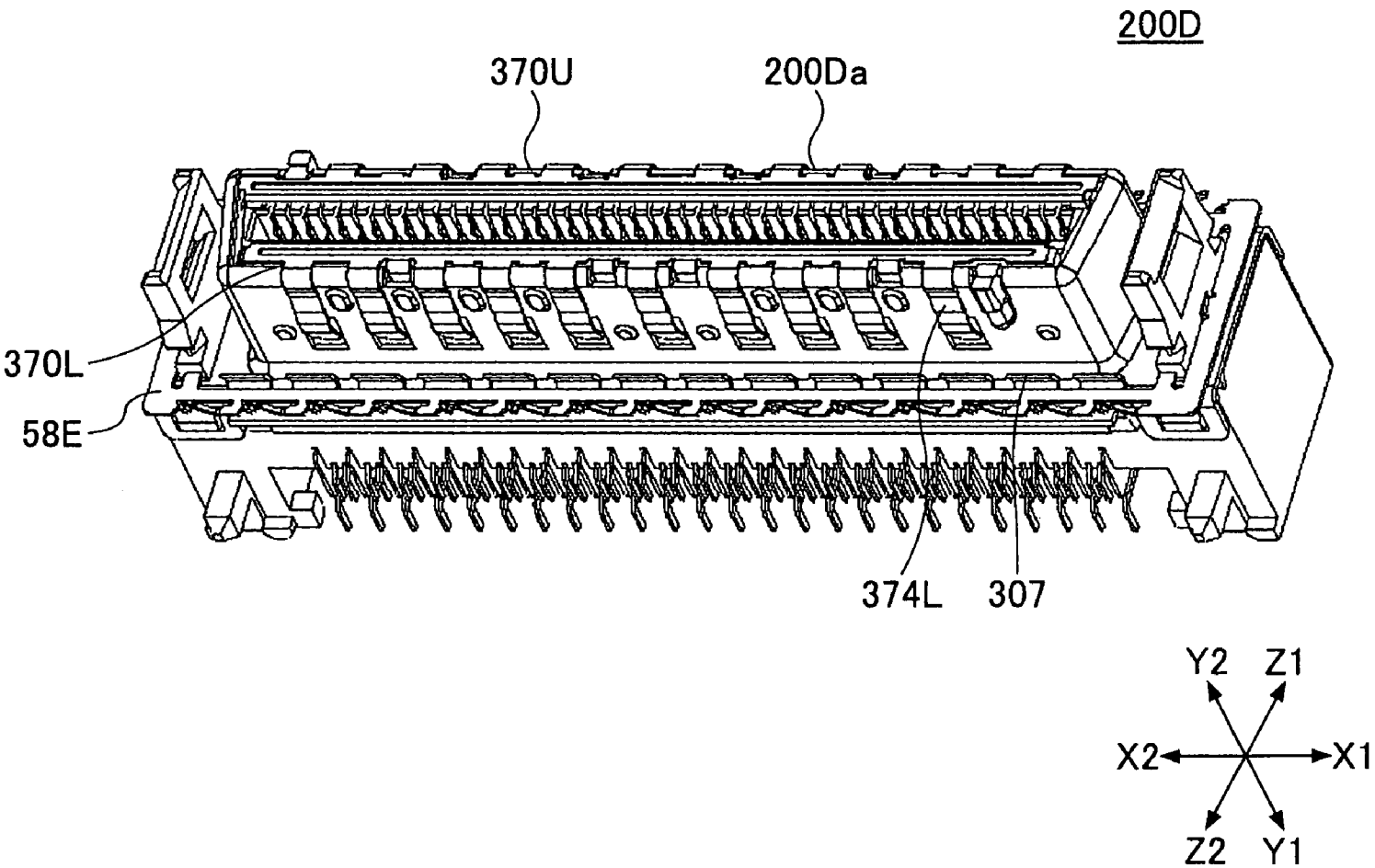
FIG. 34 is a perspective view of a jack-side connector according to a ninth embodiment of the present invention.

FIG. 34 is a diagram showing a jack-side connector 200D according to a ninth embodiment of the present invention.

The jack-side connector 200D has a configuration where the gasket 58 in the jack-side connector 200C shown in FIG. 27 is replaced with the gasket 58E shown in FIG. 23. That is, the jack-side connector 200D includes the electromagnetic shield leaf spring members 370U and 370L as leaf spring members for a jack-side electromagnetic shield shown in FIGS. 27 and 28 and the gasket 58E shown in FIG. 23.

Figure 35A:
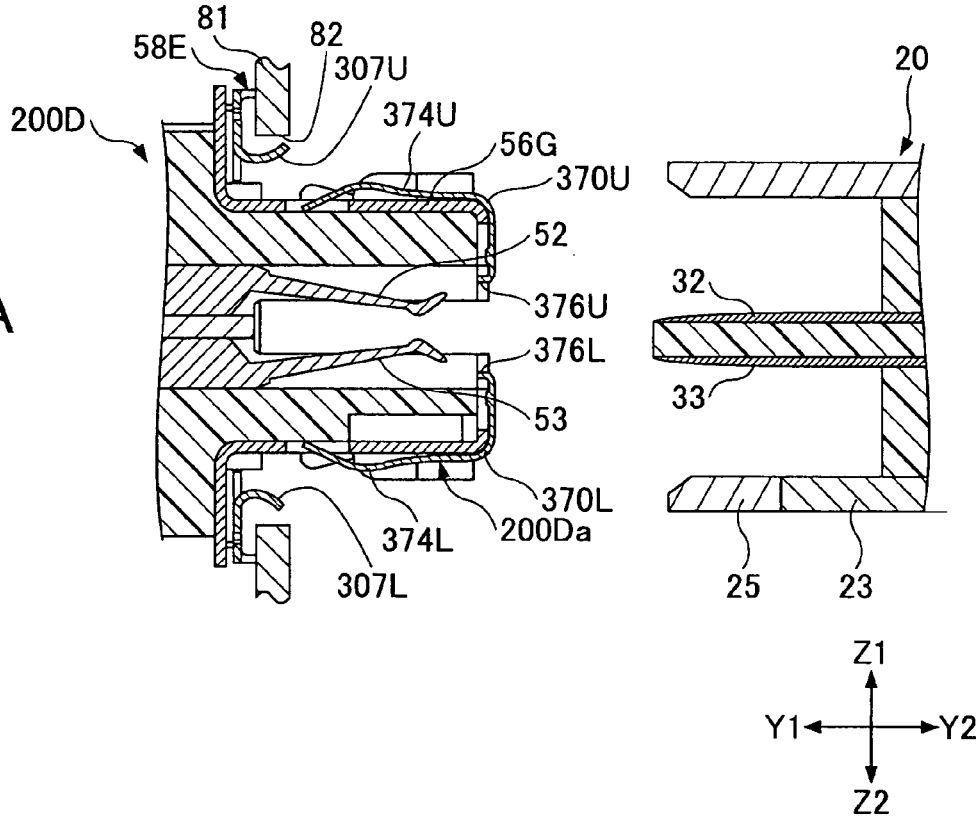
FIG. 35A is a diagram showing the plug-side connector and the jack-side connector of FIG. 34 face to face with each other.
Figure 35B:
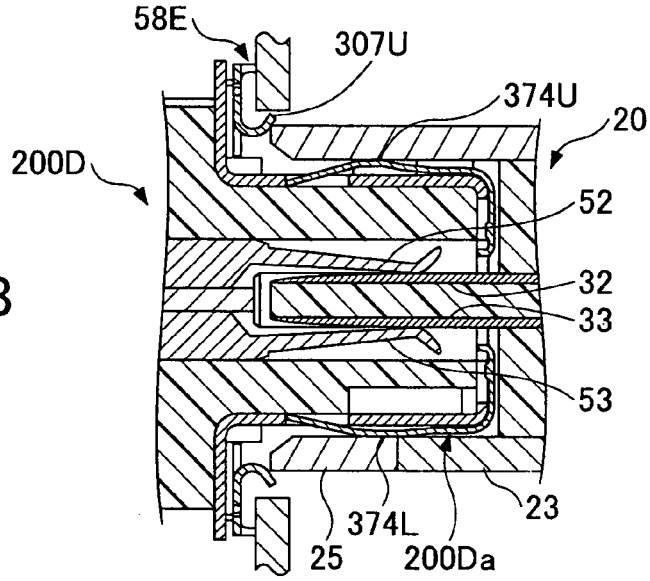
FIG. 35B is a diagram showing the plug-side connector connected to the jack-side connector of FIG. 34 according to the ninth embodiment of the present invention

FIGS. 35A and 35B are diagrams for illustrating connection of the plug-side connector 20 to the jack-side connector 200D. As shown in FIG. 35B, when the plug-side connector 20 is connected to the jack-side connector 200D so as to surround a projecting part 200Da of the jack-side connector 200D, the leaf spring pieces 374U and 374L come into elastic contact with the frame part 25 of the plug-side connector 20, so that a double electromagnetic shield is provided. As a result, even if the plug-side connector 20 is moved, the electromagnetic shield is maintained without being broken.

According to one aspect of the present invention, there is provided a plug-side connector to be connected to a jack-side connector, including a conductive housing configured to surround an electromagnetically shielded projecting part of the jack-side connector upon the plug-side connector being connected to the jack-side connector; and a leaf spring member for a plug-side electromagnetic shield, the leaf spring member including multiple conductive leaf spring pieces arranged at a pitch enabling formation of the electromagnetic shield, the leaf spring member being provided to the housing so that the leaf spring pieces are arranged in a width direction of the housing on the interior side of the housing, wherein the leaf spring pieces are configured to come into elastic contact with a surface of the projecting part of the jack-side connector upon the plug-side connector being connected to the jack-side connector.

According to the above-described plug-side connector, the leaf spring pieces are in elastic contact with the surface of the projecting part of the jack-side connector with the plug-side connector being connected to the jack-side connector. Accordingly, even if the plug-side connector is moved, the projecting part and the leaf spring pieces remain in contact with each other, so that the electromagnetic shield is maintained without being broken.

According to one aspect of the present invention, there is provided a jack-side connector to be connected to a plug-side connector, including a projecting part covered with a conductive electromagnetic shield cover member having multiple openings, the projecting part being configured to be surrounded by the conductive housing of the plug-side connector when the plug-side connector is connected to the jack-side connector; and a leaf spring member for a jack-side electromagnetic shield, the leaf spring member having multiple conductive leaf spring pieces arranged at a pitch enabling formation of the electromagnetic shield, the leaf spring member being provided so that one or more of the leaf spring pieces project through a corresponding one or more of the openings of the electromagnetic shield cover member, wherein the one or more of the leaf spring pieces projecting through the corresponding one or more of the openings of the electromagnetic shield cover member come into elastic contact with the interior surface of the housing of the plug-side connector when the plug-side connector is connected to the jack-side connector.

According to one aspect of the present invention, there is provided a jack-side connector to be connected to a plug-side connector, including a projecting part covered with a conductive electromagnetic shield cover member, the projecting part being configured to be surrounded by the conductive housing of the plug-side connector when the plug-side connector is connected to the jack-side connector; and a gasket having a quadrilateral frame shape, the gasket being fitted to the projecting part, wherein the gasket includes multiple leaf spring pieces arranged at a pitch enabling formation of an electromagnetic shield, the leaf spring pieces being capable of coming into elastic contact with an end of the housing of the plug-side connector when the plug-side connector is connected to the jack-side connector.

According to one aspect of the present invention, there is provided a jack-side connector to be connected to a plug-side connector, including a projecting part covered with a conductive electromagnetic shield cover member, the projecting part being configured to be surrounded by the conductive housing of the plug-side connector when the plug-side connector is connected to the jack-side connector; and a leaf spring member for a jack-side electromagnetic shield, the leaf spring member having multiple conductive leaf spring pieces arranged at a pitch enabling formation of the electromagnetic shield, the leaf spring member being provided to the projecting part so that the leaf spring member is electrically connected to the electromagnetic shield cover member and the leaf spring pieces are arranged side by side on the exterior side of the projecting part, wherein the leaf spring pieces are configured to come into elastic contact with the interior surface of the housing when the plug-side connector is connected to the jack-side connector.

According to one embodiment of the present invention, there is provided a connector unit including a jack-side connector having an electromagnetically shielded projecting part; and the above-described plug-side connector, the plug-side connector being configured to connect to the jack-side connector.

According to one embodiment of the present invention, there is provided a connector unit including a plug-side connector having a conductive housing; and any of the above-described jack-side connectors, the jack-side connector being configured to connect to the plug-side connector.

The present invention is not limited to the specifically disclosed embodiments, and variations and modifications may be made without departing from the scope of the present invention.

The present application is based on Japanese Priority Patent Application No. 2007-049506, filed on Feb. 28, 2007, the entire contents of which are hereby incorporated by reference.

What is claimed is:

1. A plug-side connector to be connected to a jack-side connector, comprising:

a conductive housing configured to surround an electromagnetically shielded integral projecting part of the jack-side connector upon the plug-side connector being connected to the jack-side connector; and a leaf spring member for a plug-side electromagnetic shield, the leaf spring member including a plurality of conductive leaf spring pieces arranged at a pitch enabling formation of the electromagnetic shield, the leaf spring member being provided to the housing so that the leaf spring pieces are arranged in a width direction of the housing on an interior side of the housing, wherein the leaf spring pieces are configured to come into elastic contact with a surface of the integral projecting part of the jack-side connector upon the plug-side connector being connected to the jack-side connector.

2. The plug-side connector as claimed in claim 1, wherein the leaf spring pieces of the leaf spring member are disposed so as to have respective ends facing toward an end of the housing, and each of the leaf spring pieces is shaped so that upon the plug-side connector being connected to the jack-side connector, a first portion of an end part of the leaf spring piece comes into elastic contact with the surface of the integral projecting part of the jack-side connector and a second portion of the end part of the leaf spring piece comes into elastic contact with an edge of an opening of a panel through which opening the integral projecting part of the jack-side connector projects.

3. The plug-side connector as claimed in claim 1, wherein the leaf spring member further comprises a plurality of additional conductive leaf spring pieces arranged at the pitch enabling the formation of the electromagnetic shield, the additional conductive leaf spring pieces are arranged on an exterior side of the housing in the width direction of the housing with the leaf spring member being provided to the housing, and the additional leaf spring pieces are configured to come into elastic contact with an edge of an opening of a panel through which opening the integral projecting part of the jack-side connector projects upon the plug-side connector being connected to the jack-side connector.

4. The plug-side connector as claimed in claim 1, wherein the leaf spring member is provided to the housing so that the leaf spring pieces have respective ends facing toward an inside of the housing.

5. A connector unit, comprising:

a jack-side connector having an electromagnetically shielded integral projecting part; and a plug-side connector as set forth in claim 1, the plug-side connector being configured to connect to the jack-side connector.

6. The plug-side connector as claimed in claim 1, wherein the leaf spring pieces are arranged on a first interior side and a second interior side of the housing so as to come into contact with a first surface and a second surface, respectively, of the integral projecting part of the jack-side connector.

* * * * *